US009982539B2

(12) United States Patent
Eckert

(10) Patent No.: US 9,982,539 B2
(45) Date of Patent: May 29, 2018

(54) TURBOMACHINES HAVING GUIDE DUCTS

(71) Applicant: DUERR CYPLAN Ltd., Aldermaston, Reading (GB)

(72) Inventor: Frank Eckert, Bad Lobenstein (DE)

(73) Assignee: DUERR CYPLAN LTD., Aldermaston (GB)

( * ) Notice: Subject to any disclaimer, the term of this patent is extended or adjusted under 35 U.S.C. 154(b) by 836 days.

(21) Appl. No.: 14/266,283

(22) Filed: Apr. 30, 2014

(65) Prior Publication Data

US 2014/0234094 A1 Aug. 21, 2014

Related U.S. Application Data

(63) Continuation-in-part of application No. PCT/EP2012/071774, filed on Nov. 2, 2012.

(30) Foreign Application Priority Data

Nov. 3, 2011 (DE) ..... 10 2011 117 593
Nov. 3, 2011 (DE) ..... 20 2011 107 502 U

(51) Int. Cl.
*F01D 1/08* (2006.01)
*F01D 25/30* (2006.01)
(Continued)

(52) U.S. Cl.
CPC ..... *F01D 1/08* (2013.01); *F01D 1/026* (2013.01); *F01D 1/06* (2013.01); *F01D 25/30* (2013.01)

(58) Field of Classification Search
CPC ..... F01D 1/08; F01D 1/06; F01D 1/16; F01D 1/026; F04D 25/00; F03B 15/06
See application file for complete search history.

(56) References Cited

U.S. PATENT DOCUMENTS 2,021,289 A 11/1935 Caylor
2,524,549 A * 10/1950 Theimer ..... F01D 1/14 415/170.1

(Continued)

FOREIGN PATENT DOCUMENTS

DE 2733066 8/1978
DE 102006005843 5/2007

(Continued)

OTHER PUBLICATIONS

Patent Coooperation Treaty, "International Preliminary Report on Patentability," issued by the International Searching Authority in connection with PCT Application No. PCT/EP2012/071774, dated May 6, 2014, 1 page.

(Continued)

*Primary Examiner* — Mark Laurenzi
*Assistant Examiner* — Shafiq Mian
(74) *Attorney, Agent, or Firm* — Hanley, Flight and Zimmerman, LLC

(57) ABSTRACT

Turbomachines having guide ducts are disclosed. One disclosed example turbomachine includes a rotor rotatable about an axis of rotation and having rotor blade ducts, a housing having housing ducts to allow the inflow or outflow of working medium and guide blade ducts fixed in the housing, where the rotor blade ducts are in fluid communication with the housing ducts via the guide blade ducts.

27 Claims, 22 Drawing Sheets

(51) Int. Cl.
*F01D 1/02* (2006.01)
*F01D 1/06* (2006.01)

(56) References Cited

U.S. PATENT DOCUMENTS 2,694,950 A * 11/1954 Guentsche ..... F16H 45/00 192/41 A
3,378,229 A * 4/1968 Erwin ..... F01D 1/06 415/144
3,761,195 A 9/1973 Eskeli
4,150,918 A 4/1979 Theis, Jr.
4,177,005 A * 12/1979 Bozung ..... F01D 9/026 415/128
4,729,715 A * 3/1988 Wilde ..... F01D 17/146 415/150
7,574,862 B2 * 8/2009 Giselmo ..... F01D 9/026 123/562
8,043,052 B2 * 10/2011 Konter ..... F01D 5/142 415/191
9,097,258 B2 * 8/2015 Hofer ..... F04D 21/00
9,447,723 B2 * 9/2016 Hirth ..... F02B 37/025
2003/0002975 A1 * 1/2003 Dudebout ..... F01D 5/142 415/1
2009/0290974 A1 * 11/2009 Bayere ..... F01D 5/143 415/58.5
2010/0158665 A1 * 6/2010 Hofer ..... F04D 21/00 415/66
2013/0004329 A1 * 1/2013 Shiraichi ..... F04D 29/282 416/243
2013/0309071 A1 * 11/2013 Hunter ..... F03B 13/22 415/146

FOREIGN PATENT DOCUMENTS

GB 1127684 9/1968
JP 2009264106 11/2009
WO 2013064674 5/2013

OTHER PUBLICATIONS

Patent Coooperation Treaty, "Written Opinion of the International Searching Authority," issued by the International Searching Authority in connection with PCT Application No. PCT/EP2012/071774, dated May 6, 2014, 6 pages.
Patent Coooperation Treaty, "International Search Report," issued by the International Searching Authority in connection with PCT application No. PCT/EP2012/071774, dated Jun. 19, 2013, 6 pages.
Patent Coooperation Treaty, "Written Opinion," issued by the International Searching Authority in connection with PCT application No. PCT/EP2012/071774, dated Jun. 19, 2013, 6 pages.

* cited by examiner

TURBOMACHINES HAVING GUIDE DUCTS

RELATED APPLICATIONS

This patent arises from a continuation-in-part of International Patent Application No. PCT/EP2012/071774, which was filed on Nov. 2, 2012, which claims priority to German Patent Application No. 20 2011 107 502, which was filed on Nov. 3, 2011, and German Patent Application 10 2011 117 593, which was also filed on Nov. 3, 2011. The foregoing International Patent Application and German Patent Applications are hereby incorporated herein by reference in their entireties.

FIELD OF THE DISCLOSURE

This disclosure relates generally to turbomachines, and, more particularly, to turbomachines having guide ducts.

BACKGROUND

Turbomachines with a housing and a rotor are shown in Japanese Patent No. JP 9 264 106 A. In such known turbomachines, pressure energy of working medium can be converted into mechanical work and vice-versa. In such turbomachines, problems are encountered when the rotor blades are supplied with working medium flowing faster than the speed of sound (i.e., a supersonic flow). The efficiency of conversion of pressure energy in these turbomachines and, hence, the performance of these turbomachines may be reduced due to pressure surges, etc.

Figure 1:
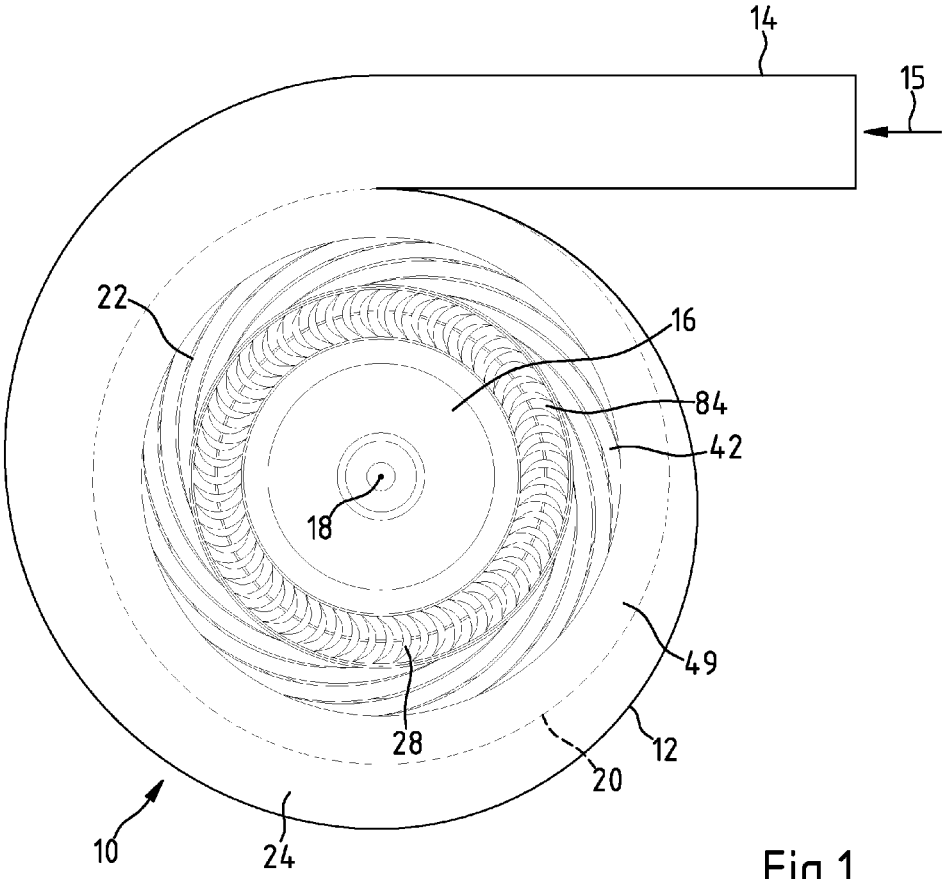
FIG. 1 shows an example turbomachine with a housing in accordance with the teachings of this disclosure.

The figures are not to scale. Instead, to clarify multiple layers and regions, the thicknesses of the layers may be enlarged in the drawings. Wherever possible, the same reference numbers will be used throughout the drawing(s) and accompanying written description to refer to the same or similar parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

The examples disclosed herein relate to a turbomachine having a housing with a housing duct for the inflow or outflow of working medium, and a rotor positioned to be rotatable about an axis of rotation. The rotor has a multiplicity of rotor blades, which form rotor blade ducts.

The examples disclosed herein provide a turbomachine of high efficiency, in which rotor blades of such turbomachines can be provided with a supersonic flow. In particular, the examples disclosed herein enable a turbomachine suitable to be used as a turbine or compressor in an Organic Rankine Cycle ("ORC") system.

In some examples, turbomachines have rotor blade ducts to communicate with a housing duct via guide blade ducts. The guide blade ducts of such turbomachines are fixed in relation to the housing and have a guide blade duct opening on the rotor side and a guide blade duct opening on the housing duct side.

Turning to the figures, FIG. 1 shows an example turbomachine 10 having a housing 12 in accordance with the teachings of this disclosure. The housing 12 of the illustrated example has a pipe connection 14 for the supply or discharge of working medium. A rotor 16 is mounted on a shaft in the housing 12 to be rotatable about an axis of rotation 18. The rotor has a multiplicity of rotor blades 28, which form a rotor blade ring. In this example, a guide blade support 20 of the illustrated example, which has guide blades 22, is fixed in the housing 12. In this example, the housing 12 has a housing duct 24, which can be supplied with working medium flowing in a direction generally indicated by an arrow 15 via the pipe connection 14 when the turbomachine 10 is operated as a turbine. When the turbomachine 10 of the illustrated example is operated as a compressor, the working medium is discharged from the housing duct 24 via the pipe connection 14.

Figure 2:
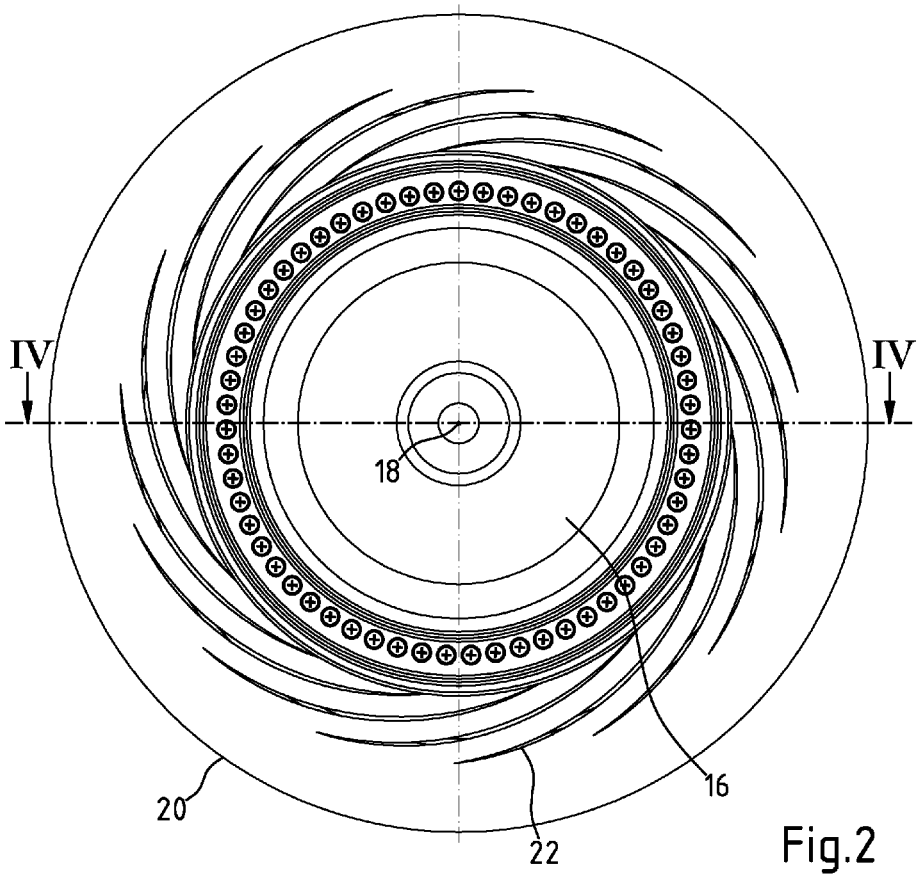
FIG. 2 shows a guide blade support and a rotor of the example turbomachine of FIG. 1.
Figure 3:
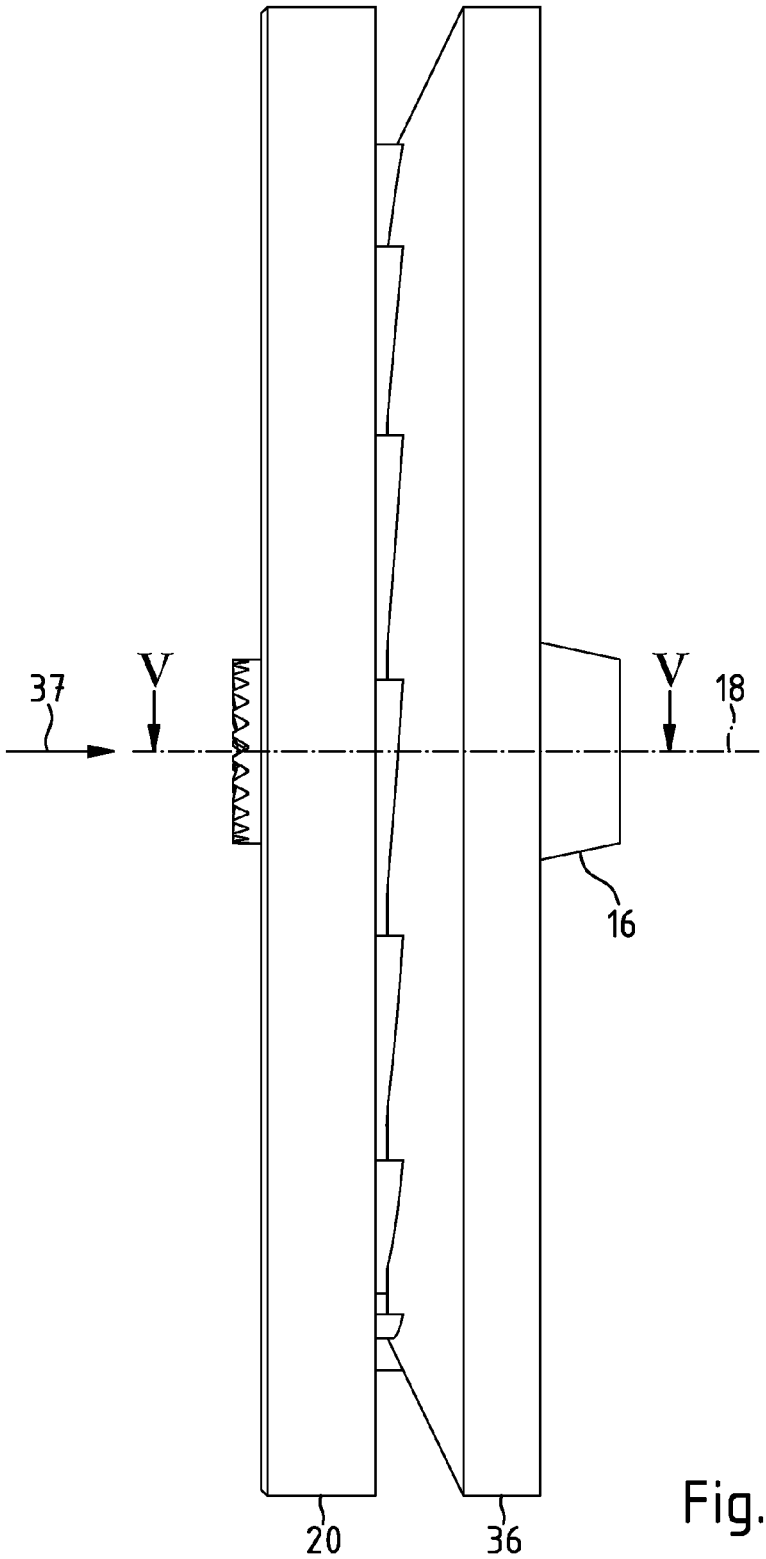
FIG. 3 shows a side view of the guide blade support and the rotor of FIG. 2.
Figure 4:
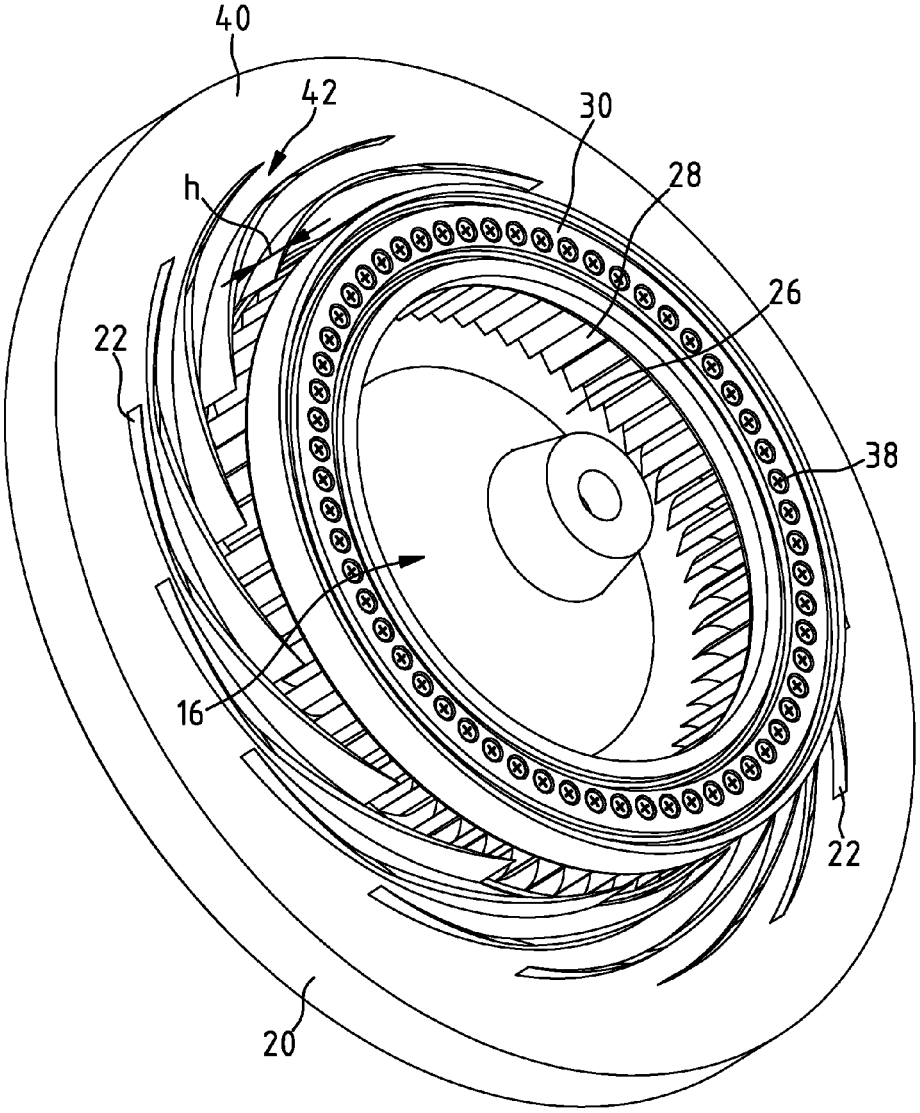
FIG. 4 shows a perspective view of the rotor and the guide blade support of FIGS. 2 and 3.
Figure 5:
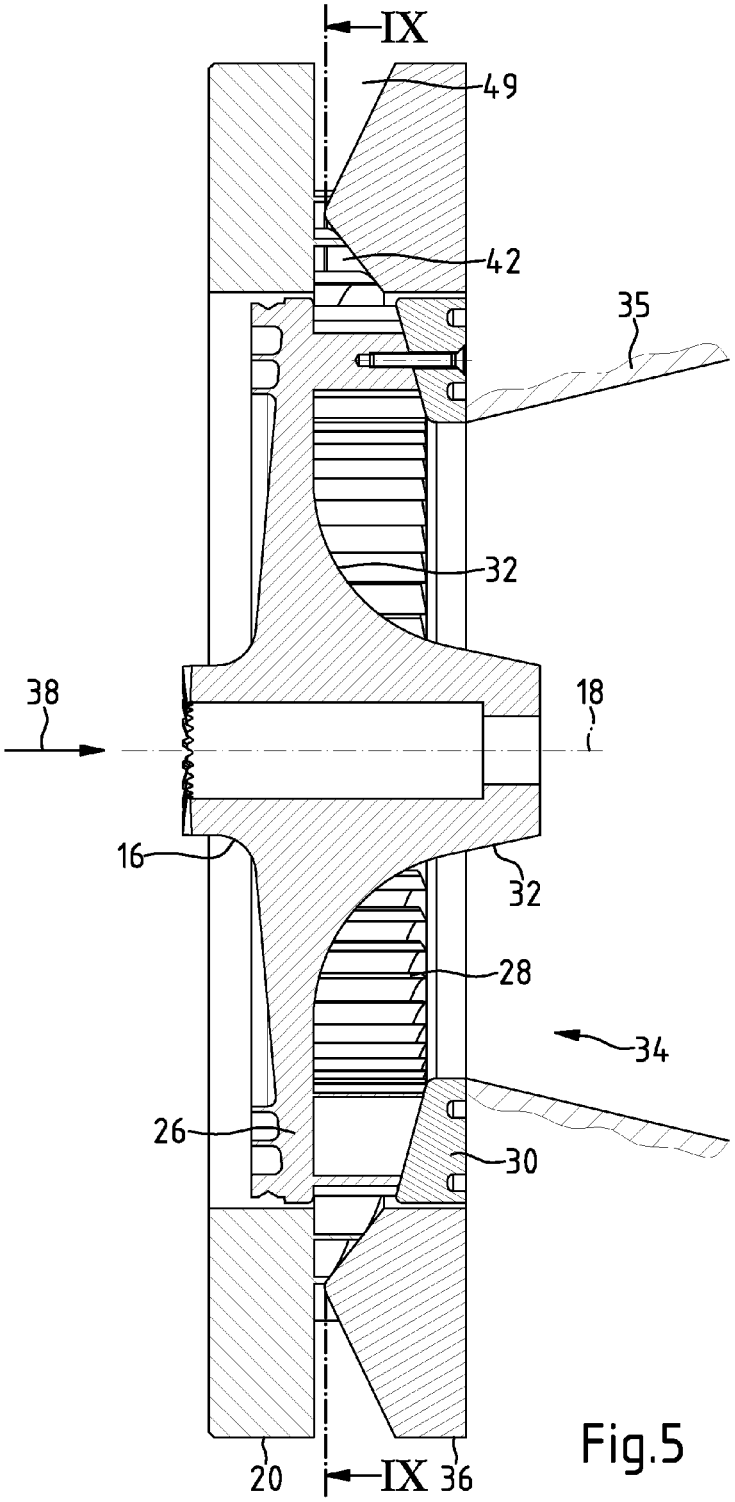
FIG. 5 shows a section view through the rotor and the guide blade support along the line V-V of FIG. 3.
Figure 6:
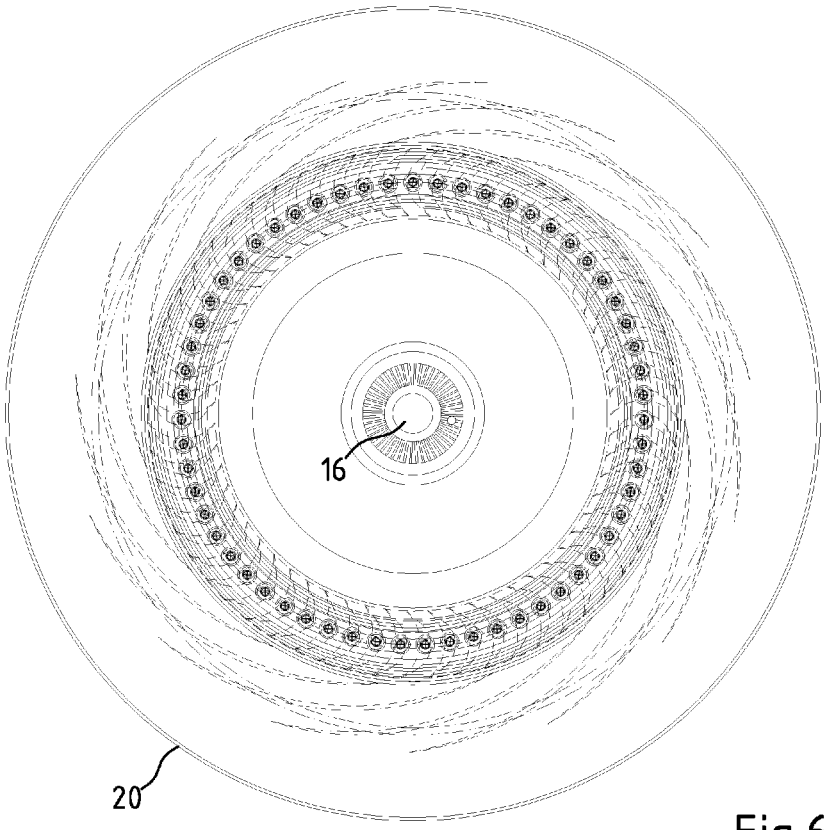
FIG. 6 shows a rear view of the guide blade support and the rotor of FIG. 2.

FIG. 2 and FIG. 3 show the guide blade support 20 with the rotor 16 in a plan view and a side view, respectively. In FIG. 4, the rotor 16 and the guide blade support 20 are depicted in a perspective view. FIG. 5 shows the guide blade support 20 with the rotor 16 in the form of a section view along the line V-V of FIG. 3. FIG. 6 shows the guide blade support 20 and the rotor 16 in a rear view in a direction generally indicated by an arrow 37 of FIG. 3.

The rotor 16 of the illustrated example has a rotor blade support 26, to which the rotor blades 28 are fixed (e.g., coupled) by a material bond. In this example, the rotor blades 28 are stabilized and shrouded on the side facing away from the rotor blade support by an annular shroud ring member 30, which is connected to the rotor blades 28 via fastening screws 38. The rotor blade support 26 of the illustrated example has a guide contour 32 that is rotationally symmetrical in relation to the axis of rotation 18 and extends into a diffuser space 34 of a diffuser 35. The rotor blades 28 form (e.g., define) rotor blade ducts 84, which deflect the working medium flowing between the housing duct 24 and the diffuser space 34. The guide blades 22 are connected materially (e.g., coupled, adhered, integral, etc.) to the guide blade support 20. The guide blade support 20 is assigned an annular cover 36, which is held in the housing 12. In this example, the annular cover 36, by means of a connecting surface 33, forms spirally curved guide blade ducts 42 with the guide blade support 20 and the guide blades 22. The guide blade of the illustrated example ducts each act as Laval nozzles.

Figure 7:
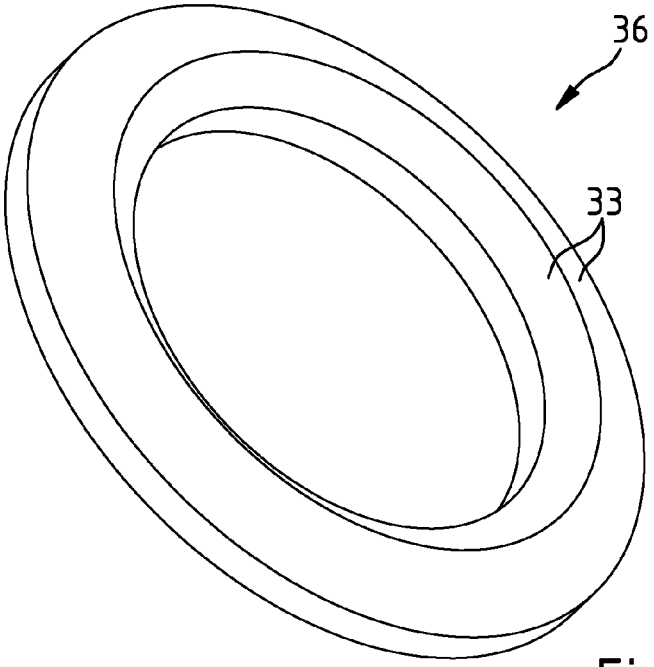
FIGS. 7 and 8 show an annular cover for the guide blades of the guide blade support of FIG. 2.
Figure 8:
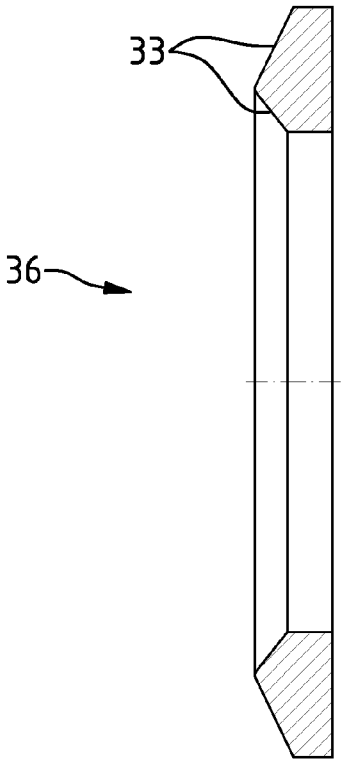

In some examples, the guide blade support 20 and the guide blades 22 are produced (e.g., integrally formed) from a flanged socket. In regards to production engineering, such integration enables the possibility of producing and/or forming the shape of the guide blades 22 from the guide blade support 20 by milling, erosion and/or electrolytic machining after turning, for example, to produce a curved slope on the side facing the annular cover 36. The guide blade support 20 of the illustrated example has a mounting flange 40, by which the guide blade support 20 can be fixed to the housing 12 of the turbomachine 10. FIG. 7 shows the annular cover 36 in the turbomachine 10 in a perspective view. FIG. 8 shows section view of the annular cover 36. The cover 36 of the illustrated example may also be produced at low cost as a rotationally symmetrical turned part which has a matching connecting surface 33 congruent with the guide blades 22 of the guide blade support 22.

Figure 9:
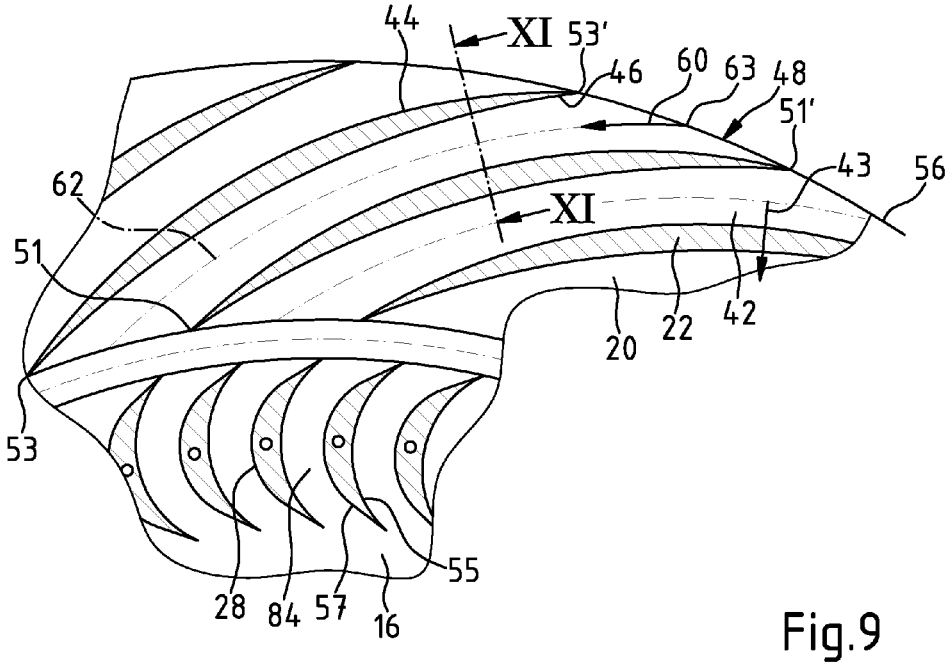
FIG. 9 shows a sectional detail view of the guide blade support and the rotor.

FIG. 9 is a sectional detail view of the guide blade support 20 and the rotor 16. Each of the guide blades 22 of the illustrated example has a concave guide blade surface 46 facing the rotor 16 and a guide blade surface 44 that is convex. In this example, each of the guide blade surfaces 44, 46 defines a wall surface of a guide blade duct 42. Each guide blade duct 42 has a center line 62, which corresponds to a curved line with a curvature vector 43 pointing generally towards the rotor 16. In some examples, the guide blades 22 have guide blade edges 51, 53 on the rotor side and guide blade edges 51', 53' on the housing duct side.

The guide blades 22, in some examples, are machined from the guide blade support 20 by, for example, an end mill because the bottom wall of a guide blade duct 42 is relatively flat, the cross-sectional profile of a guide blade duct 42 has edges and/or each guide blade duct 42 has a substantially similar design. By guiding the end mill, for example, any desired straight or curved guide blade duct shape sloping toward the axis of rotation 18 and having the same width or variable width may be produced.

Figure 10:
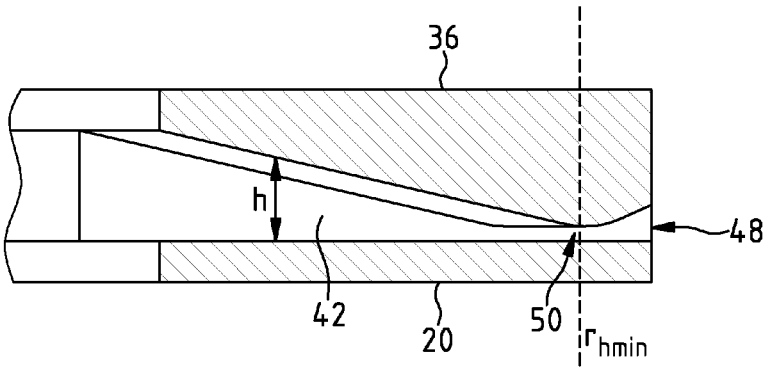
FIG. 10 shows a longitudinal section view through a guide blade duct.
Figure 11:
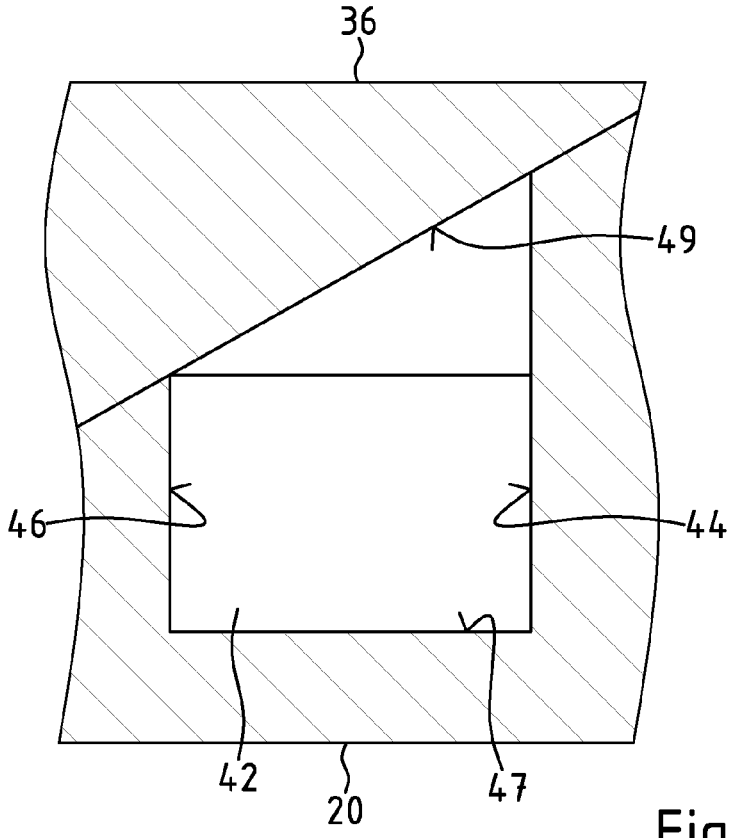
FIG. 11 shows a cross sectional view through a guide blade duct.

FIG. 10 is a longitudinal sectional detail view of the guide blade support 20 along the center line 62 in a section plane generally parallel to the axis of rotation 18. By matching (e.g., following the contour) the connecting surface 33 of the annular cover 36 to this curved slope when mounting the annular cover 36 may produce a guide blade duct geometry that has a constriction 50 with a minimum cross section at the radius $r_{min}$ relative to the axis of rotation 18. On the rotor side of the constriction 50, the cross section of the guide blade duct is divergent (i.e., its free cross-sectional area increases toward the rotor 16). In this example, on the housing duct side of the constriction 50, the cross section of the guide blade duct 42 is convergent (i.e., the free cross-sectional area decreases toward the rotor 16 starting from the housing duct 24). As shown in FIG. 11, each guide blade duct 42 of the illustrated example has wall surfaces formed (e.g., defined) by the blade surfaces 44, 46 of the guide blades, a flat bottom surface 47 and a sloping top surface 49.

Figure 12:
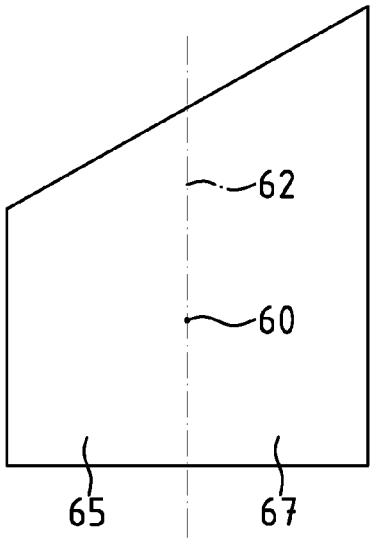
FIG. 12 shows a cross-sectional profile of a guide blade duct.

FIG. 12 shows a trapezoidal cross-sectional profile of the guide blade duct 42. In this example, the flow path 60 of the working medium passes through the center line 62 of the guide blade duct 42. The center line 62 of the illustrated example divides the guide blade duct 42 into a segment 65 on the housing duct side and a segment 67 on the rotor side. In relation to the center line 62, the cross-sectional profile of the guide blade duct 42 is asymmetrical. In this example, the free cross-sectional area of the segment 67 on the rotor side is greater than the free cross-sectional area of the segment 65 on the housing duct side.

Figure 13:
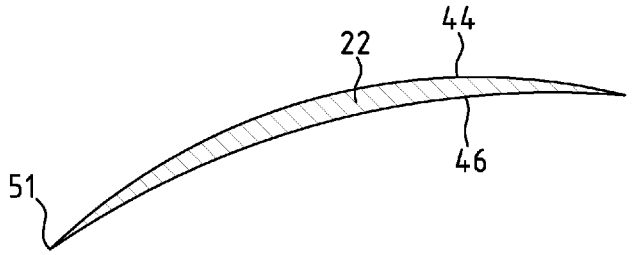
FIG. 13 shows a longitudinal section through a guide blade of the example turbomachine of FIG. 1.

FIG. 13 is a longitudinal section through a guide blade 22. In this example, each guide blade 22 has a respective concave blade surface 46 and a convex blade surface 44.

The rotor 16 of the illustrated example with the rotor blade support 26 and the rotor blades 28 may be produced by milling, erosion and/or electrolytic machining. In some examples, the rotor blade support 26 is produced on a machine tool as a turned part that has a thick edge with a bevel. In some examples, the rotor blade ducts 84 are then machined from this edge by erosion, electrolytic machining and/or milling. In some examples, the use of an end mill is especially suitable since the bottom of the corresponding ducts may be flat over the entire length of the ducts and each duct is of the same or similar depth. In some examples, by guidance of the end mill, any desired straight or curved duct shape sloping toward the axis of rotation 18 and of the same width or of variable width may be generated. In some examples, the annular shroud ring member 30 allows the desired nozzle duct geometry with an inlet and outlet edge on each rotor blade to be produced by the bevel of the rotor blade support 26.

Figure 14:
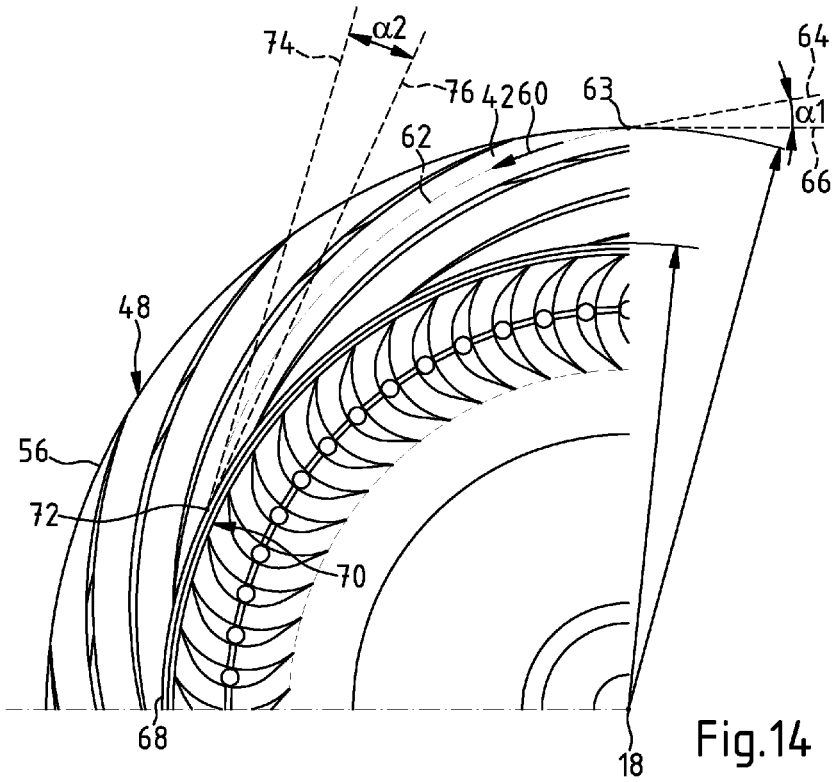
FIG. 14 shows another sectional detail view of the guide blade support and the rotor of FIG. 2.

The guide blade ducts 42 have openings 48 on the housing side. As shown in FIG. 14, the guide blade ducts 42 of the illustrated example guide the working medium in the center line 62 with the flow path 60 that passes through the cylinder circumferential surface 56 at a point of intersection 63. In this example, at the point of intersection 63, the tangent 64 to the center line 62 and the tangent 66 to the cylinder circumferential surface 56 define an acute angle $\alpha 1$, where the tangent 66 lies in a plane substantially perpendicular to the axis of rotation 18. On the rotor side, the guide blade ducts 42 of the illustrated example have openings 70 lying on a cylinder circumferential surface 68 and arranged coaxially relative to the axis of rotation 18. In this example, the flow path 60 of working medium in the center line 62 of the guide blade ducts 42 passes through the cylinder circumferential surface 68 at a point of intersection 72, at which the tangent 74 to the center line 62 and the tangent 76 to the cylinder circumferential surface 68 define an angle $\alpha 2$ to which the tangent 76 lies in a plane substantially perpendicular to the axis of rotation 18 and the following relationship may apply: $\alpha 2 \approx 12°$.

Figure 15:
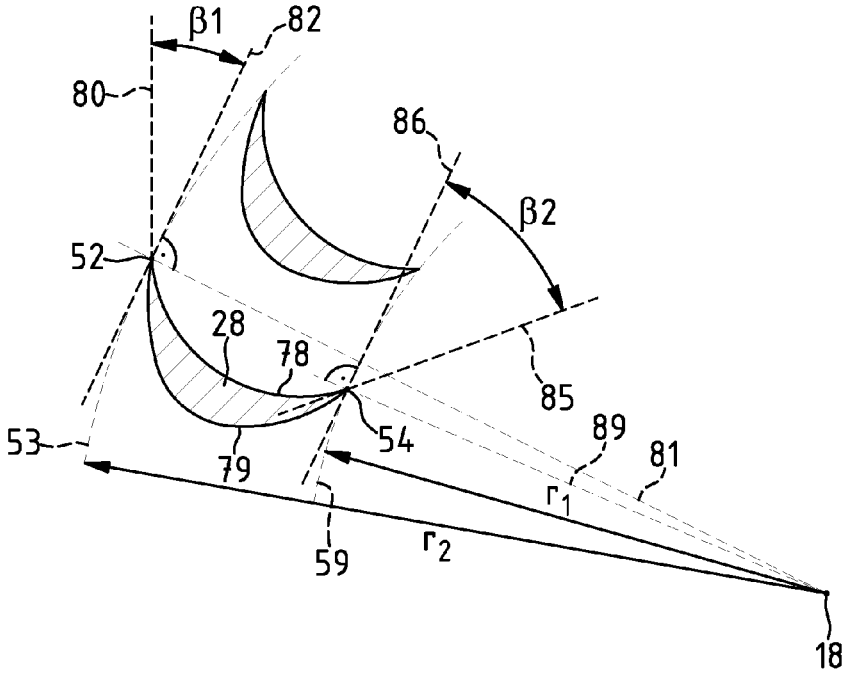
FIG. 15 shows a sectional detail view of the rotor of FIG. 2.

FIG. 15 shows a sectional detail view of a segment of the rotor with rotor blades 28. The rotor blades 28 of the illustrated example have a substantially crescent-shaped cross-sectional contour and a concave blade surface 78 that extends from a first rotor blade edge 52 at a distance r2 from the axis of rotation 18 to a second rotor blade edge 54. In this example, the first rotor blade edge 52 faces the guide blade ducts 42 that face away from the guide blade ducts 42 and is at a distance $r_1$ from the axis of rotation 18. In this example, the rotor blade edges 52 that face the guide blade ducts 42 lie on a cylinder circumferential surface 53 that is coaxial with the axis of rotation 18 and has a radius of $r_2$. The rotor blade edges 54 of the illustrated example that face the axis of rotation 18 are positioned on a cylinder circumferential surface 59, which is coaxial with the axis of rotation 18 and has a radius of $r_1$.

In this example, a tangent 80, which lies in a plane perpendicular to the axis of rotation 18 and applied to the concave blade surface 78 at the first rotor blade edge 52, and a tangent 82 to the cylinder circumferential surface 53, which is coaxial with the axis of rotation 18, define an angle $\beta 1$, in which the tangent 82 passes through the first rotor blade edge 52 and lies in a plane substantially perpendicular to the axis of rotation 18, and the following may apply: $\beta 1 \approx 29°$. In some examples, a tangent 85, which lies in a plane perpendicular to the axis of rotation 18 and is applied to the concave blade surface 78, and a tangent 86 to the cylinder circumferential surface 59 in a plane perpendicular to the axis of rotation define an angle $\beta 2$, in which the tangent 86 passes through the second rotor blade edge 54 and the following may apply: $\beta 2 \approx 40.5°$. In other words, in some examples, the tangent 80 defines an angle: $\widetilde{\beta 1}:\beta 1+90°$ with the straight line 81, which passes through the first blade edge 52 and perpendicularly intersects the axis of rotation 18, where the angle $\widetilde{\beta 1} \approx 119°$. Likewise, in some examples, a tangent 80 lying in a plane perpendicular to the axis of rotation 18 and applied to the concave blade surface 78 at the second blade edge 54 forms an angle: $\widetilde{\beta 2} = 90° - \beta 2$ with a straight line 89, which passes through the second blade edge 54 and perpendicularly intersects the axis of rotation 18, where the angle $\widetilde{\beta 2} \approx 49.5°$.

Figure 16:
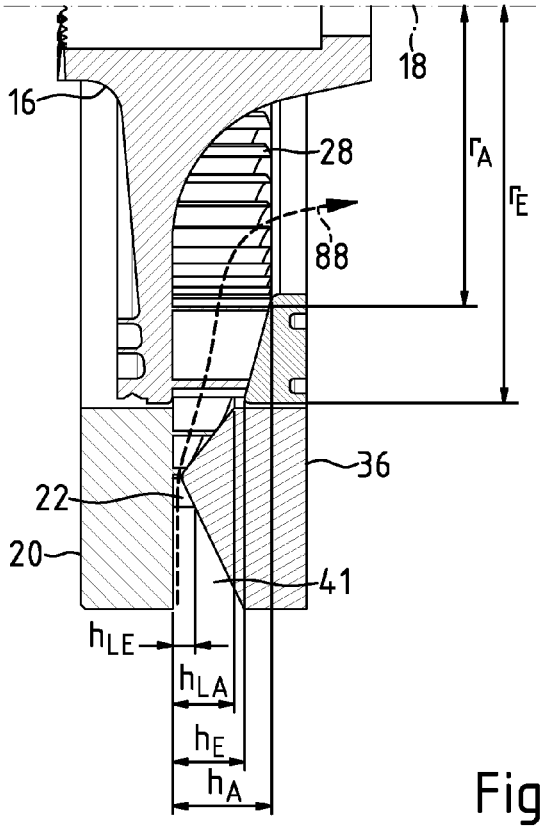
FIG. 16 shows another sectional detail view of the guide blade support and the rotor of FIG. 2.

FIG. 16 shows a sectional detail view of a segment of the rotor support 20 with the rotor 16 of FIG. 5 on a relatively larger scale. In examples where the turbomachine 10 is operated as a turbine, the working medium flows along the flow path 88 out of the housing duct 24 and into the diffuser space 34. The working medium of the illustrated example passes through a compensating space 41 and into the guide blade ducts 42, which are formed by the guide blades 22 and have the inlet height $h_E$ on the housing duct side. The working medium then impinges on the blades 28 of the rotor 16 at the rotor inlet radius $r_E$. In this example, the height of the guide blade ducts 42 at the outlet opening on the rotor side corresponds to the inlet height $h_E$. In this example, the working medium flows in the direction of the straight line 80 in FIG. 15 onto the rotor blades, which have the height $h_E$ at the inlet edge 52. The rotor 16 of the illustrated example has an outlet radius $r_A$. At the outlet edge 54, the rotor blades 28 of the illustrated example have the height $h_A$. In this example, at the guide blade edges 51, 53 (i.e., where the working medium emerges from the guide blades), the guide blades have the height $h_{LA}$.

In this example, the distance $r_2$ of the first blade edge 52, which faces the guide blade ducts 42, of each rotor blade 28 from the axis of rotation 18 and the distance $r_1$ of the second blade edge 54, which faces away from the guide blade ducts, of each rotor blade 28 from the axis of rotation 18 satisfy the following relation: $r_1/r_2 \approx 75\%$.

In this example, the following relation applies to the number Z=59 of the rotor blades 28 of the rotor 16: $Z \approx C \cdot r_1/r_2$, where $r_2$ is the distance of the first blade edge 52, which faces the guide blade ducts 42, of each rotor blade 28 from the axis of rotation 18, and where $r_1$ is the distance of the second blade edge 54, which faces away from the guide blade ducts 42, of each rotor blade 28 from the axis of rotation 18 where C=78.66 is a constant within the number interval [70, 90].

In this example, the distance $r_2$ of the first blade edge 52, which faces the guide blade ducts 42 of each rotor blade 28, from the axis of rotation 18 and the height $h_E$, which is parallel to the axis of rotation 18, of the first blade edge 52 of each rotor blade 28 satisfy the following relation:

$$12\% \leq h_E/r_2 \leq 28\%.$$

The shape visible in FIG. 10 of each guide blade duct 42 in the turbomachine 10 ensures that each guide blade duct 42 can act as a Laval nozzle. In other words, such a shape enables the working medium to flow at supersonic speed on the rotor side of the constriction 50 when the pressure of the working medium in the housing duct 24 exceeds a threshold. It is therefore possible to ensure that the rotor 16 can be supplied with working medium moving at speeds higher than supersonic speeds. The shape of the guide blade ducts 42 in a spiral segment shape and/or the curvature directed toward the rotor 16 ensures that a pressure gradient substantially radially symmetrical with respect to the axis of rotation 18 is established in the guide blade ducts 42.

Figure 17:
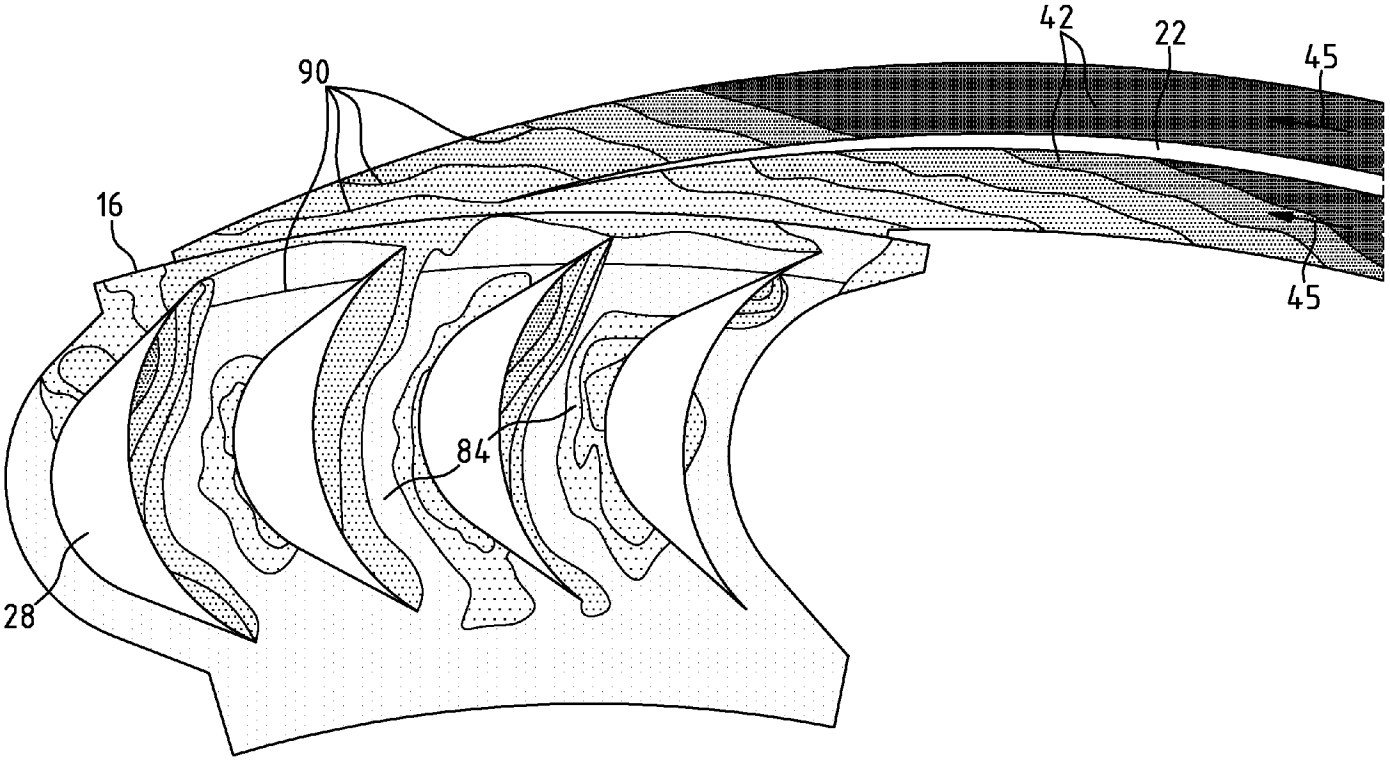
FIG. 17 shows a pressure profile in working medium that is moved through the turbomachine.

FIG. 17 shows a typical pressure profile in the guide blade ducts 42 and the rotor blade ducts 84 when the working medium of the turbomachine 10 flows in the direction of the arrows 45 at supersonic speed. In the guide blade ducts 42 of the illustrated example, the isobars 90 that are evident in the pressure field are substantially radially symmetrical with respect to the axis of rotation 18 of the rotor 16 of the turbomachine. Such symmetry results in substantially no or minimal pressure surges of the rotor blade ducts 50 and/or the guide blade ducts 42. In this example, the working medium can flow out of the housing duct 24, through the guide blade ducts 42 and to the diffuser space 34 via the rotor 16 in a manner where it almost completely transfers its momentum to the rotor blades 28 and does not dissipate the momentum in pressure surges, which reduce the efficiency of the turbomachine 10.

In some examples, the turbomachine 10 described above is suitable for use as a turbine in an Organic Rankine Cycle process or for compressing working medium in an Organic Rankine Cycle process.

Figure 18:
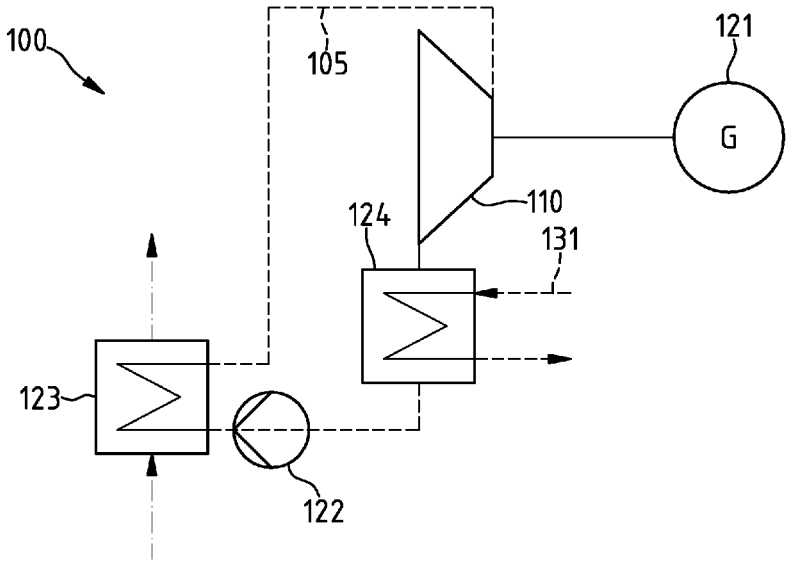
FIG. 18 shows an Organic Rankine Cycle ("ORC") system with a turbomachine.

FIG. 18 shows an ORC system 100 having a turbomachine 110 operating as a steam turbine and positioned in a working medium circuit 105. In this example, butane, toluene, silicone oil, ammonia, methylcyclohexane and/or ethylbenzene are used as fluid working media. A generator 121 of the illustrated example is coupled to the turbomachine 110, which may have the structure described by the preceding figures. In this example, the ORC system 100 has a working medium condenser 124. The ORC system 100 of the illustrated example has a feed pump 122 acting as a working medium pump. By the feed pump 122, the fluid working medium is brought to operating pressure in the liquid state of aggregation. In this example, the liquid working medium flows through a heat exchanger 123 acting as an evaporator.

During such a process, the working medium evaporates. Saturated steam or dry steam is then made available at the outlet of the heat exchanger 123. Because of the energy input in the heat exchanger 123, the specific volume and temperature of the steam increase during such a process.

In this example, the working medium steam is then expanded to a lower pressure through the turbomachine 110 coupled to a generator 121 in a virtually isentropic manner. As a result, the specific volume increases because of the expansion. The associated increase in the volume of the working medium caused by the pressure difference results in volumetric work, which the turbomachine 110 converts into mechanical energy at its blades. The turbomachine 110 of the illustrated example drives the generator 121.

In this example, the steam from the turbomachine 110 passes into the working medium condenser 124, which is a heat exchanger through which a coolant circuit 131 containing a cooling liquid passes through. Because of the coolant circuit 131, the heat released during condensation is fed into a heat distribution system. In some examples, the heat of the coolant carried in the coolant line 131 is released (e.g., distributed) to the environment via a heat exchanger.

In this example, within the heat exchanger, which functions (e.g., acts) as a working medium condenser 124, the working medium condenses and changes into the liquid state of aggregation. In this example, the feed pump 122, which acts as a working medium pump, enables the working medium to be brought back to operating pressure and returns the working medium to the heat exchanger 123 acting as an evaporator. The circuit for the working medium in the ORC system 2 is then closed.

Figure 19:
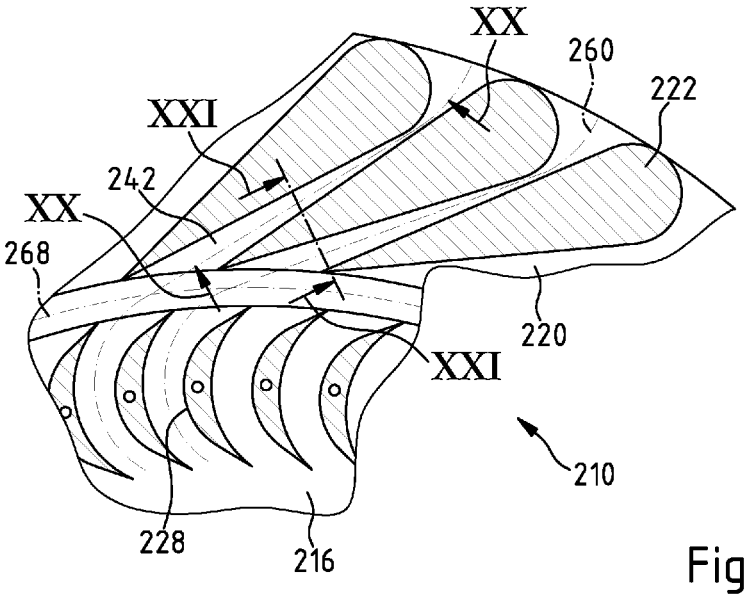
FIG. 19 shows a sectional detail view of an additional example turbomachine having a guide blade support and a rotor.

FIG. 19 is a sectional detail view of a guide blade support 220 and of a rotor 216 of an additional example turbomachine 210, the construction of which corresponds fundamentally to that of the example turbomachine 10 described by FIGS. 1 through 16. Functionally identical elements in the figures relating to turbomachine 10 and turbomachine 210 are therefore indicated below by numbers incremented by the number 200 as a reference. The turbomachine 210 of the illustrated example has guide blade ducts 242, through which the working medium can flow out of the housing duct via the flow path 260 and onto the rotor blades 228 of the rotor 216.

Figure 20:
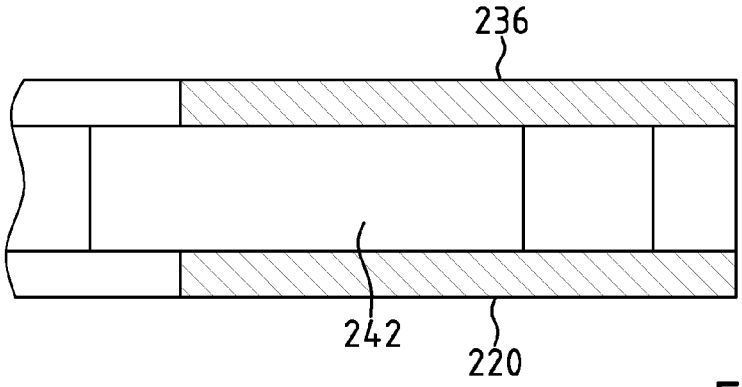
FIG. 20 shows a longitudinal section through a guide blade duct of the additional example turbomachine of FIG. 19.
Figure 21:
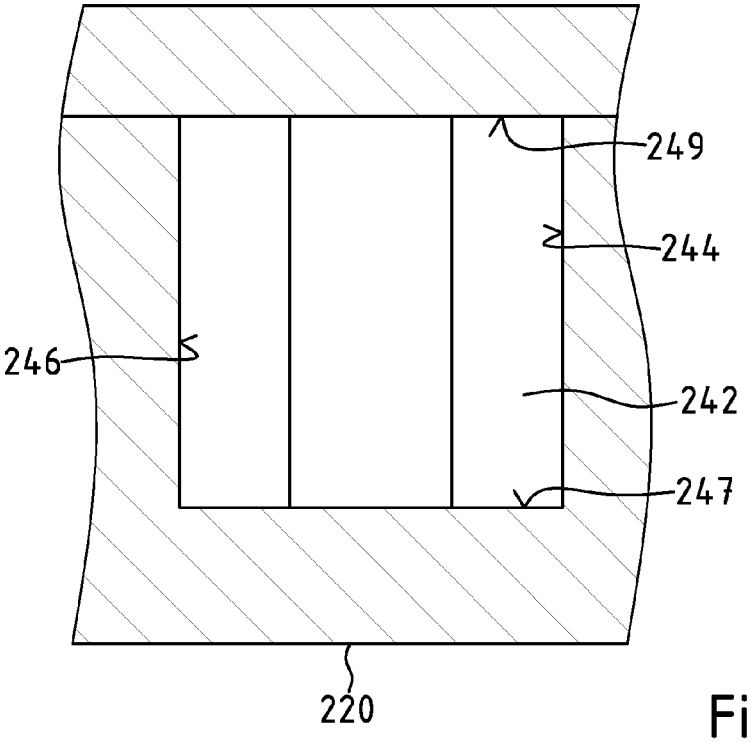
FIG. 21 shows a cross section view through the guide blade duct of FIG. 20 of the additional example turbomachine of FIG. 19.

FIG. 20 shows a guide blade duct 242 of the flow path 260 thereof, which extends in the center line 262 of the guide blade duct 242 in a direction generally indicated by the arrows XX-XX of FIG. 19. In FIG. 21, the guide blade duct 242 is shown as a section in the direction of the arrows XXI-XXI of FIG. 19. In this example, the guide blade duct 242 acts as a Laval nozzle for working medium flowing out of the housing duct, which can impinge at supersonic speed on the blade surfaces 278 of the rotor 216 at an angle $\alpha 2=12°$ to the tangent to a cylinder circumferential surface 268 coaxial with the axis of rotation of the rotor 216. The tangent lies in a plane perpendicular to the axis of rotation of the rotor 216. In other examples, angles of $8° \leq \alpha 2 \leq 22°$ are also possible.

Figure 22:
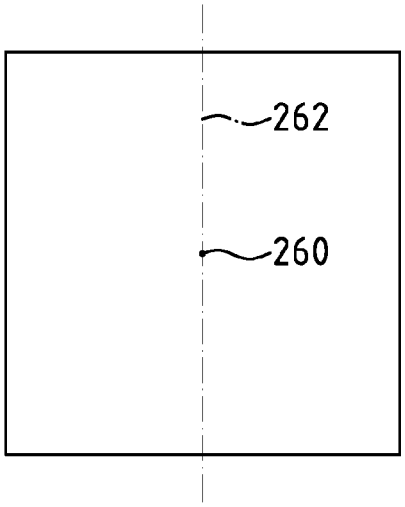
FIG. 22 shows a cross-sectional profile of the guide blade duct of FIG. 20.
Figure 23:
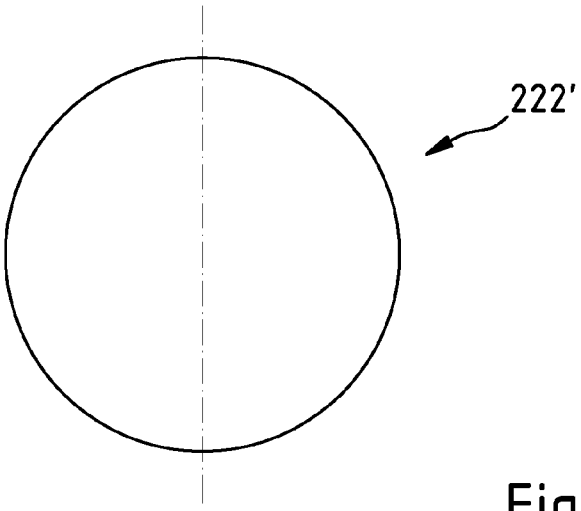
FIG. 23 shows a cross-sectional profile of a guide blade duct of an additional third example turbomachine.
Figure 24:
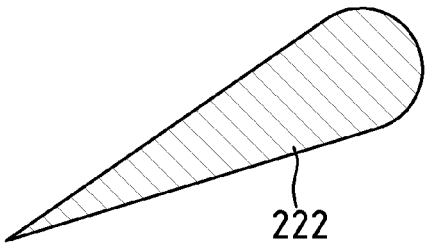
FIG. 24 shows a longitudinal section through a guide blade in the third example turbomachine of FIG. 23.

FIG. 22 shows the rectangular cross sectional profile of the guide blade duct 222. FIG. 23 shows the cross sectional profile 222' of a guide blade duct of an additional example turbomachine, which has corresponding construction to the above turbomachines. In this example, the cross sectional profile 222' of this guide blade duct is not rectangular, but round. FIG. 24 shows a guide blade 222 from FIG. 19 in a longitudinal section.

Figure 25:
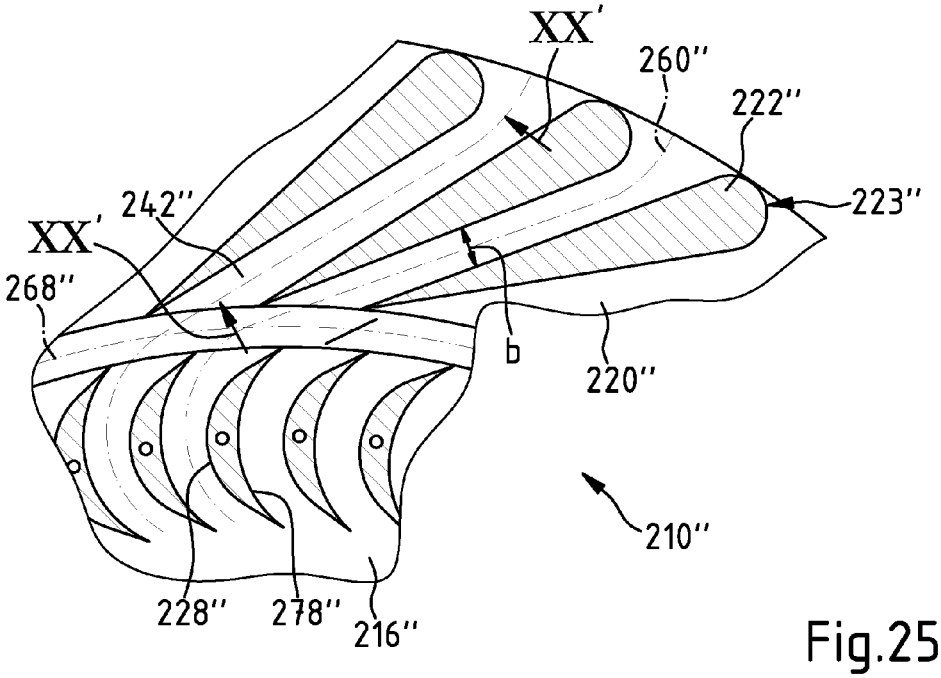
FIG. 25 shows a sectional detail view of an additional example turbomachine having a guide blade support and a rotor.

FIG. 25 is a sectional detail view of a guide blade support 220" and of a rotor 216" in an additional turbomachine 210", the construction of which corresponds fundamentally to the turbomachine 10 described in connection with FIGS. 1 through 16. Functionally identical elements in the figures relating to turbomachine 10 and turbomachine 210" are therefore indicated below by numbers incremented by the number 200 as references. Turbomachine 210" of the illustrated example has guide blade ducts 242", through which the working medium can reach the rotor blades 228" of the rotor 216" on the flow path 260" out of the housing duct. In this example, the guide blades 222" are rounded in the manner of a segment of a cylinder circumference at their ends 223" facing the housing duct to enable working medium from the housing duct to enter the guide blade ducts with reduced flow losses. In particular, the guide blades 228" of the illustrated example have a radius of between 1 mm and 5 mm in their cross section, which is shown in connection with FIG. 25. At least one guide blade duct 242", preferably all the guide blade ducts, has an at least locally constant width b. The segment of constant width b preferably extends along at least half of a housing duct bounded by two guide blades 222".

Figure 26:
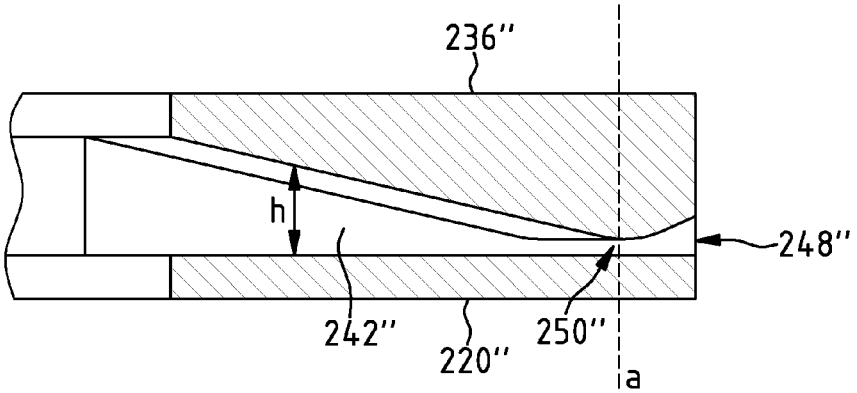
FIG. 26 shows a longitudinal section through a guide blade duct in the example turbomachine of FIG. 25.

FIG. 26 shows a guide blade duct 242" of the flow path 260" thereof, which extends in the center line 262" of the guide blade duct 242" in a direction generally indicated by the arrows XX"-XX" of FIG. 25. In this example, each of the guide blade duct 242" acts as a Laval nozzle for working medium flowing out of the housing duct, which can impinge at supersonic speed on the blade surfaces 278" of the rotor 216" at an angle $\alpha 2=12°$ to the tangent to a cylinder circumferential surface 268" coaxial with the axis of rotation of the rotor 216". The tangent of the illustrated example lies in a plane perpendicular to the axis of rotation of the rotor 216".

Each guide blade duct 242" in the turbomachine 210" has a constriction 250" with a narrowest cross section at a distance a from the cylinder circumferential surface 268". In this example, on the rotor side of the constriction 250", the cross section of the guide blade duct is divergent (i.e., as the width b remains substantially similar, the height h increases toward the rotor 216"). On the housing duct side of the constriction 250", the cross section of the guide blade duct 242" is convergent (i.e., the cross-sectional area decreases toward the rotor 216") from the housing duct. In other examples, other nozzle geometries including subsonic nozzles, for example, can be provided.

Figure 27:
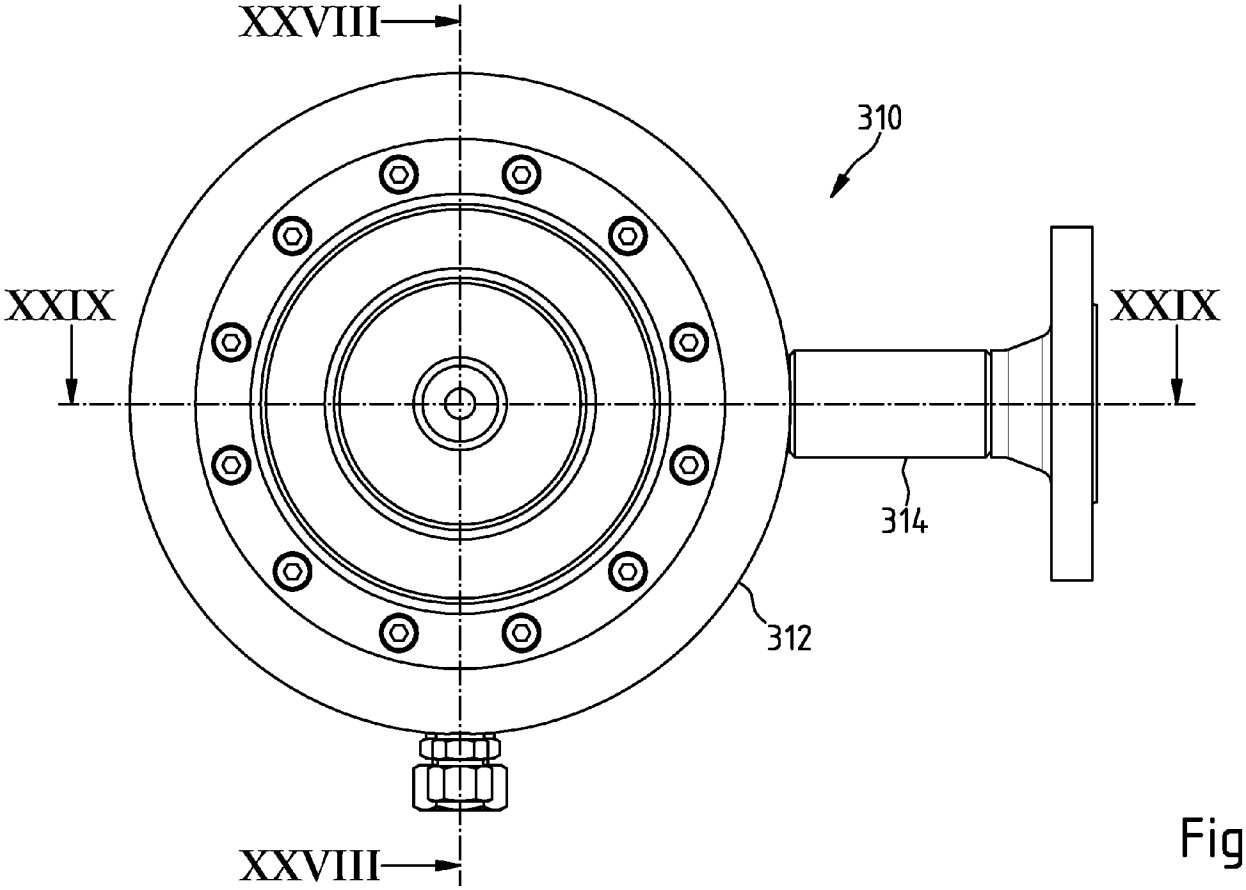
FIG. 27 shows a fourth example turbomachine having a housing.
Figure 28:
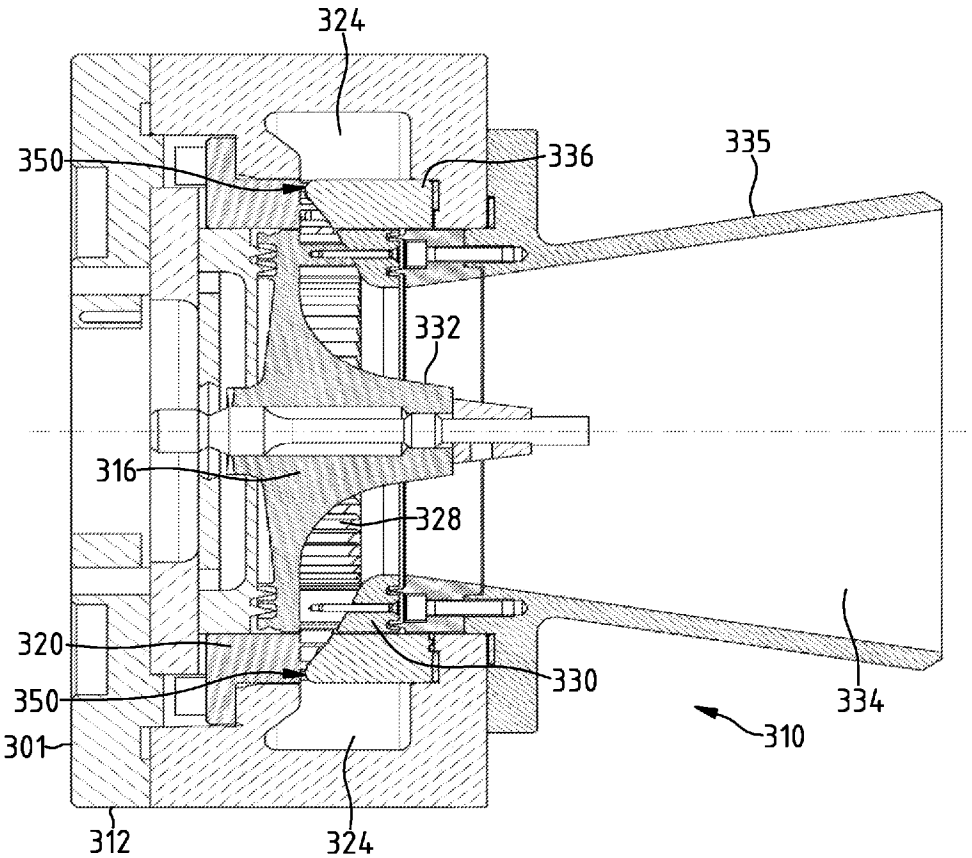
FIG. 28 shows a section view through the fourth example turbomachine along the line XXVII-XXVII of FIG. 27, with a connecting wall.
Figure 29:
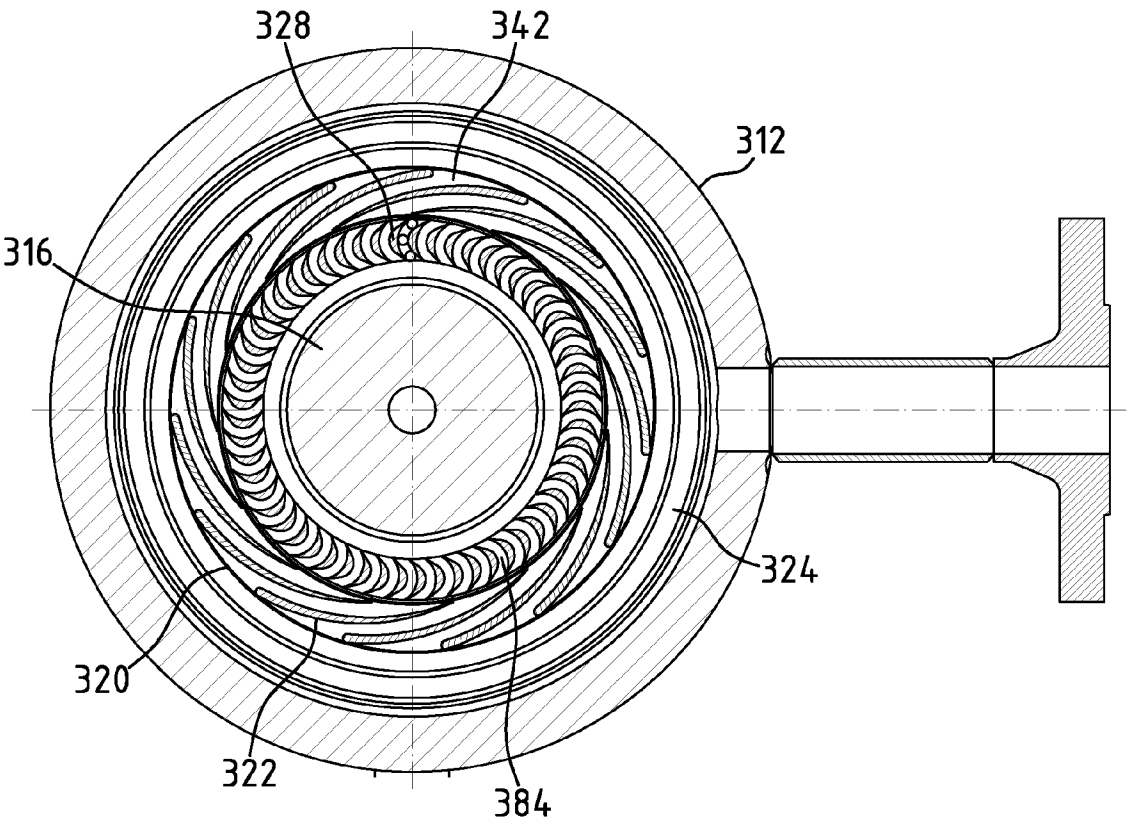
FIG. 29 shows a section view through the fourth example turbomachine along the line XXIX-XXIX of FIG. 27.
Figure 30:
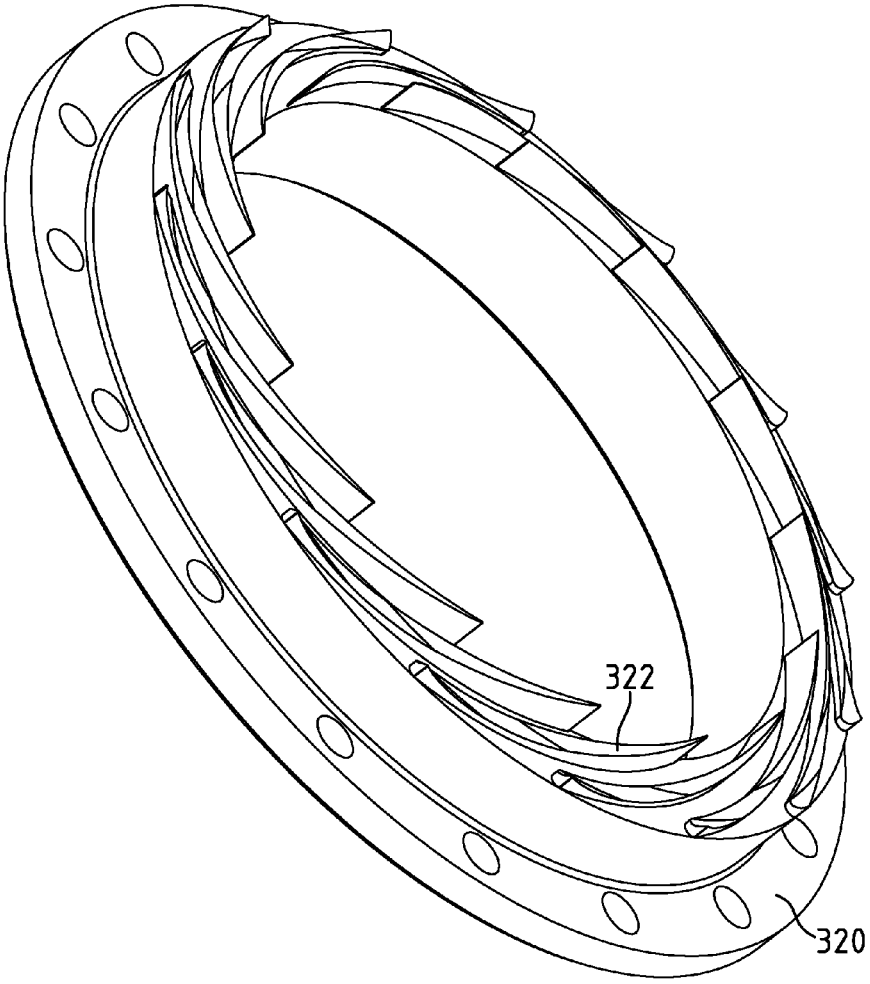
FIG. 30 shows a guide blade support with the guide blades formed thereon in the fourth example turbomachine.
Figure 31:
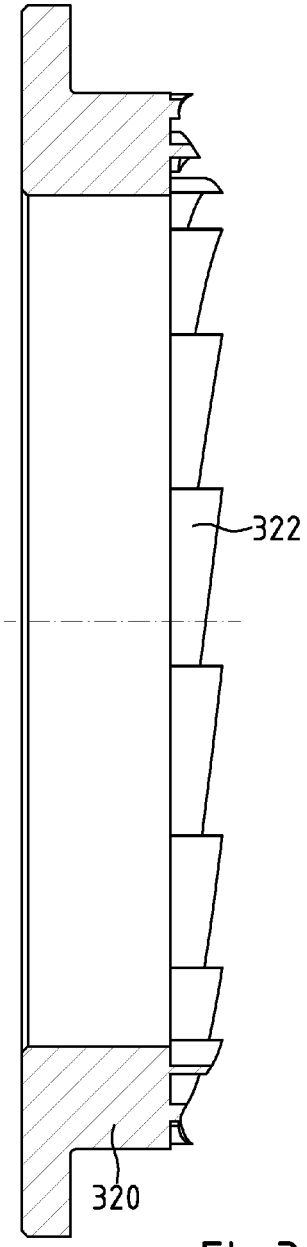
FIG. 31 shows a section view of the guide blade support with the guide blades of the fourth example turbomachine.
Figure 32:
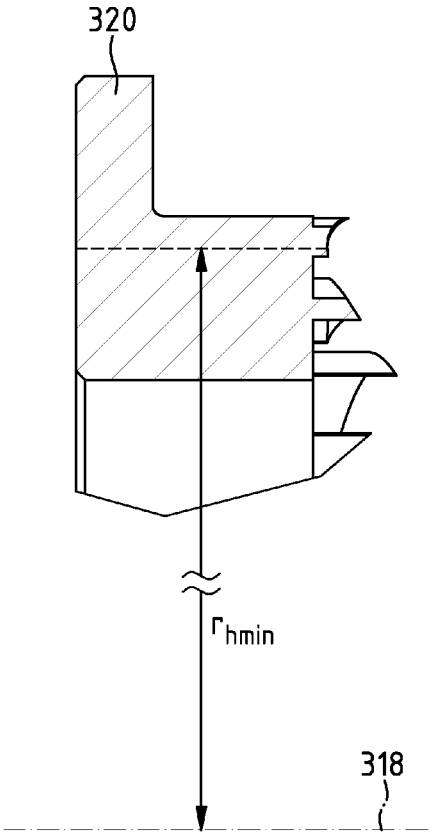
FIG. 32 shows an enlarged view of the guide blade support and the guide blades of the fourth example turbomachine.

FIG. 27 shows an additional fourth turbomachine 310. Elements which correspond functionally to one another in the figures relating to turbomachine 10 and turbomachine 310 are therefore indicated below by numbers incremented by the number 300 as references. The turbomachine 310 of the illustrated example has a cylindrical housing 312 with a pipe connection 314 designed as a flange socket. In FIG. 28, the turbomachine 310 of the illustrated example is shown as a section along the line XXVIII-XXVIII of FIG. 27 with an additional connecting wall 301. In FIG. 29, the turbomachine 310 is shown as a section along the line XXIX-XXIX of FIG. 27. In contrast to the example turbomachine 10, the housing duct 324 of the illustrated example surrounds the rotor 316 in a substantially ring-like shape. The guide blades 322 of the illustrated example are rounded at the ends 323 facing the housing duct 324 to allow working medium to enter the guide blade ducts from the housing duct with minimal flow losses. In this example, the guide blade support 320 shown in FIGS. 30, 31 and 32 having the guide blades 322 is, likewise, produced from a flanged socket, into which the guide blades 322 are machined by milling, erosion and/or electrolytic machining. The guide blade support 320 of the illustrated example has a mounting flange 340 by which the guide blade support 320 can be fixed (e.g., coupled) in the housing 312 of the turbomachine 310.

In this example, the guide blades 322 of the turbomachine 310 are covered by an annular cover 336. With the guide blade support 320 and the guide blades 322 formed thereon, the cover 336 forms guide blade ducts 342, each of which have an opening in fluid communication with the housing duct 324. In this example, the guide blade ducts 324 have a substantially spiral shape and guide the working medium on a flow path between the housing duct 324 and the rotor 316, which has a curvature directed toward the rotor 316. In this example, from the housing duct 325 to the rotor 316, the cross section of the guide blade ducts 342 tapers in relation to the axis of rotation 318 while having a substantially constant width up to the constriction 350, which is at a distance $r_{hmin}$ from the axis of rotation 318. From the constriction 350, the free cross section of the guide blade ducts 342 then increases again in the direction of the rotor 316. In this example, each of the guide blade ducts 342 thus has the shape of a spirally curved nozzle which, in the example of a Laval nozzle, initially tapers in the direction toward the rotor 316 from the housing duct 324 and then widening where the nozzle has a trapezoidal opening cross section.

Figure 33:
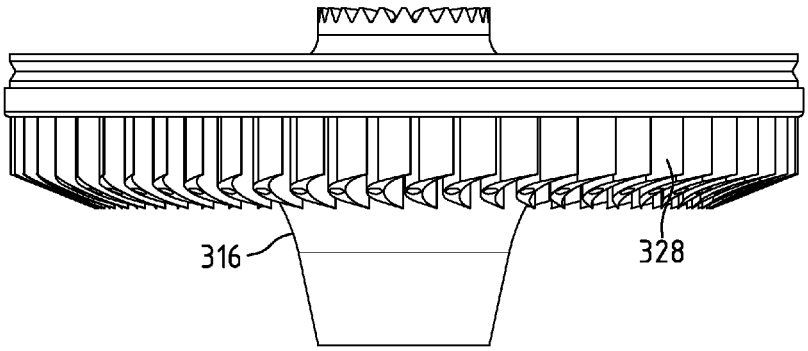
FIG. 33 shows a side view of the rotor of the fourth example turbomachine.
Figure 34:
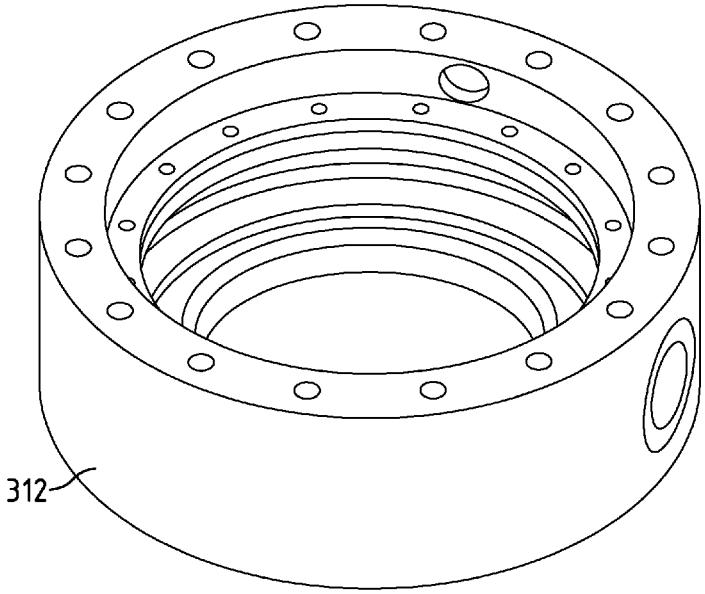
FIG. 34 shows the housing of the fourth example turbomachine.

FIG. 33 shows the rotor 316 of the turbomachine 310 without the shroud ring member 330 that shrouds the rotor blades 328, thereby forming the rotor blade ducts 384. In FIG. 34, the housing 312 of the turbomachine 310 is shown. The housing 310 of the illustrated example is generally shaped as a tubular body, into which flange segments 315, on which the guide blade support 320 and the cover 336 for the guide blade ducts 342 are coupled (e.g., fixed), are machined, preferably, by turning.

By means of this geometry, there is, in particular, an increase in the efficiency of turbomachines in ORC systems, in which the flow within the blading is usually greater than the speed of sound. Since the ducts are easier to form, there is also a reduction in manufacturing costs.

In some examples, it should be noted that a very high efficiency of a turbomachine can be achieved with the above-described geometries of the guide blade ducts 42, 242, 342 and of the rotor blades 28, 228, 328. This high efficiency may be achieved especially when such turbomachines are used as turbomachines for ORC systems, in which the speed of flow of the working medium within the rotor blading is generally above the speed of sound. Because the flow ducts in the above-described turbomachines may be formed with relative ease, these turbomachines may be produced with very low manufacturing costs. In these examples, it should be noted that the above-described production methods for the rotor blades and the guide blade ducts of the above-described turbomachines are also suitable for corresponding assemblies in axial turbines. In such axial turbines, the geometry of the ducts is preferably adapted to the change in the flow direction relative to the rotor axis as compared to a radial turbine.

The following preferred features of the examples disclosed should be noted below. The preferred examples disclosed herein relate to an example turbomachine 10 having a housing 12, which has a housing duct 24 for the inflow or outflow of working medium. The example turbomachine has a rotor 16, which is arranged to be rotatable about an axis of rotation 18 and has a multiplicity of rotor blades 50 that form rotor blade ducts 84. In this example, the rotor blade ducts 84 communicate with the housing duct 24 via guide blade ducts 42 formed in the housing.

The examples disclosed herein provide a high efficiency turbomachine in which the rotor blades can be supplied with a supersonic flow. For example, it is an object of the examples disclosed to provide a turbomachine that is suitable for use as a turbine or compressor in an ORC system.

Such a turbomachine in which the rotor blade ducts are in fluid communication with the housing duct via guide blade ducts that are fixed relative to the housing that have a guide blade duct opening on the rotor side and a guide blade duct opening on the housing duct side.

The examples disclosed herein are based on the principle that the working media in "ORC systems" (ORC=Organic Rankine Cycle), in which heat may be converted into mechanical energy via a thermodynamic cycle using a circulated organic working medium, which may include butane, toluene, silicone oil, ammonia, methylcyclohexane and/or ethylbenzene (ORC process). Such an organic working medium generally has a low evaporation temperature in relation to water for which the speed of sound is relatively low. As a result, losses that prejudice the efficiency of such a system may occur even at relatively low flow velocities in turbomachines operated in such systems.

In some examples, to lower (e.g., minimize) the flow losses in a turbomachine, the turbomachine has a housing with guide blade ducts configured to enable the formation of pressure surges coalescing in the guide blade ducts (i.e., coming together in the guide blade ducts) to be counteracted.

In some examples, the guide blade ducts are configured as Laval nozzles or in a manner similar to a Laval nozzle (i.e., as a flow element that has a constriction, a convergent cross section before the constriction and a divergent cross section after the constriction) viewed in the direction of flow when the turbomachine is operated as a turbine. In some examples, the transition from the convergent to the divergent segment of the guide blade ducts is gradual. A fluid flowing through can, therefore, be accelerated to supersonic speed in the guide blade ducts without excessive compression surges. In some examples, the speed of sound is reached precisely in the narrowest cross section of the nozzle. In some examples, the cross section of the guide blade ducts is preferably angular. However, in some examples, the guide blade ducts have a generally round-shaped cross section. In some examples, the guide blade ducts preferably have a concave wall surface that faces the rotor and against which working medium can flow. In contrast, in some examples, the wall surface of the guide blade ducts that faces away from the rotor and against which working medium can flow has a convex shape. In such examples with the convex shape, the guide blade ducts have a flow cross section that increases monotonically in a direction of flow of working medium toward the rotor ducts. For this purpose, the guide blade ducts may have a width in the plane perpendicular to the axis of rotation that increases monotonically in the direction of flow of working medium toward the rotor ducts and/or the direction for the guide blade ducts has a corresponding height in the direction of the axis of rotation that increases in a correspondingly monotonic manner.

In some examples, the guide blade ducts each have a center line that is spaced apart uniformly from a wall surface facing the rotor and a wall surface facing away from the rotor. The center line divides the cross-sectional profile of a guide blade duct into a segment on the housing duct side and a segment on the rotor side, where the cross-sectional profile of each guide blade duct is asymmetrical in relation to the center line. In this example, the segment on the housing duct side and the segment on the rotor side each preferably have a free cross-sectional area for the passage of working medium, where the free cross-sectional area of the segment on the rotor side is larger than the free cross-sectional area of the segment on the housing duct side. In some examples, the cross-sectional profile of a guide blade duct is trapezoidal.

In some examples, a turbomachine according to the examples disclosed herein can be operated as an "action" or "impulse" turbine, in which a working medium such as a gas and/or steam is accelerated in the guide blade ducts between the guide blades, a reduction in pressure of the working medium and the associated expansion occurs, and then the working medium impinges on the rotor blades of the rotor. This impingement leads to a transfer of momentum to the rotor allowing a torque to be exerted on an output shaft connected to the rotor. In some examples, the resulting mechanical power can be used to drive a generator for producing electrical energy.

In some examples, to obtain a resultant force in the direction of rotation of the rotor when supplying the rotor blades with the working medium, it is advantageous if as much as possible of the flow emerging from a guide blade duct has, to the largest extent possible, an ideal angle relative to the blade wheel for a working medium. According to the examples disclosed herein, therefore, the guide blade ducts of the turbomachine are designed to allow the working medium to be guided to the blade wheel with a flow that has a flow component perpendicular to the radius of the rotor. In some examples, the working medium is guided onto the rotor through guide blade ducts that lie in a plane substantially perpendicular to the axis of rotation of the rotor and curved toward the rotor. It has been determined that if the working medium is guided onto the rotor on a straight flow path, only a relatively small portion of the flow is at the ideal angle relative to the rotor at the end of the corresponding guide blade duct in the direction of flow. In this example, that portion of the flow that is closest to the guide blades is either at too small or too large an angle relative to the blade wheel. In the examples with supersonic flows, such flow angles cause powerful pressure surges to occur between the rotor blading and the guide blading, thereby impairing the efficiency of the turbomachine.

According to the examples disclosed herein, the guide blade ducts may be formed with openings on the housing duct side that lie on a cylinder circumferential surface arranged coaxially with the axis of rotation, and guide the working medium in the center with a flow path that passes through the cylinder circumferential surface at a point of intersection at which the tangent to the flow path and the tangent to the cylinder surface, which lies in a plane substantially perpendicular to the axis of rotation, form an angle $\alpha 1$ to which the following applies: $5° \leq \alpha 1 \leq 20°$, and preferably $\alpha 1 \approx 12°$. Such an angular relationship allows a high transfer of momentum between the rotor and the working medium. In this example, it is advantageous when the guide blade ducts have guide blade duct openings on the rotor side that lie on a cylinder circumferential surface arranged coaxially with the axis of rotation and the guide blade ducts guide the working medium in the center with a flow path that passes through the cylinder circumferential surface at a point of intersection, at which the tangent to the flow path and the tangent to the cylinder surface, which lies in a plane perpendicular to the axis of rotation, form an angle $\alpha 2$ to which the following applies: $5° \leq \alpha 2 \leq 20°$, and preferably $\alpha 2 \approx 12°$.

In some examples, it is advantageous when the rotor blades have a substantially crescent-shaped cross-sectional contour and a concave blade surface that extends from a first blade edge, which faces the guide blade ducts, to a second blade edge, which faces away from the guide blade ducts. A tangent at the first blade edge, which lies in a plane perpendicular to the axis of rotation and is applied to the concave blade surface, forms an obtuse angle $\widetilde{\beta 1} = \beta 1 + 90°$ with a straight line that passes through the first blade edge and perpendicularly intersects the axis of rotation, where $5° \leq \widetilde{\beta 1} - 90° \leq 45°$, in particular $20° \leq \widetilde{\beta 1} - 90° \leq 40°$, and preferably $\widetilde{\beta 1} - 90° \approx 29°$. In some examples, it is advantageous if a tangent lying in a plane perpendicular to the axis of rotation and applied to the concave blade surface at the second blade edge forms an acute angle $\widetilde{\beta 2} = 90° - \beta 2$ with a straight line that passes through the second blade edge and perpendicularly intersects the axis of rotation, where $5° \leq 90° - \widetilde{\beta 2} \leq 90°$, in particular $35° \leq 90° - \widetilde{\beta 2} \leq 35°$, and preferably $90° - \widetilde{\beta 2} \approx 40.5°$. For example, it is advantageous if the obtuse angle $\widetilde{\beta 1} = \oplus 1 + 90°$ and the acute angle $\beta 2 = 90° - \widetilde{\beta 2}$ satisfy the following relation: $\widetilde{\beta 1} < 180° - \widetilde{\beta 2}$ (i.e., $\beta 1 < \beta 2$). In this way, a particularly high energy efficiency of the turbomachine may be achieved.

It has been recognized that when the distance $r_2$ of the first blade edge of each rotor blade, which faces the guide blade ducts, from the axis of rotation and the distance $r_1$ of the second blade edge of each rotor blade, which faces away from the guide blade ducts, from the axis of rotation satisfy the following relation: $70\% < r_1/r_2 < 80\%$ and, preferably, $r_1/r_2 \approx 75\%$, the rotor blade ducts have a length that is favorable for working medium flowing at supersonic speed and/or a length that promotes adiabatic expansion of the working medium. It has been discovered that when the number Z of rotor blades of the rotor satisfies the relation: $Z \approx C \times r_1/r_2$, where C is a constant and where $70 \leq C \leq 90$, torque transmission between the rotor and a working medium may be maximized without excessive flow losses.

Moreover, it has been recognized that it is conducive to the energy efficiency of the turbomachine when the distance $r_2$ of the first blade edge of each rotor blade, which faces the guide blade ducts, from the axis of rotation and the height $h_E$ of the first blade edge of each rotor blade, which is substantially parallel to the axis of rotation, satisfy the following relation: $12\% \leq h_E/r_2 \leq 28\%$.

In some examples, the blade surfaces of the rotor blades can be substantially parallel to the axis of rotation of the rotor. This enables the rotor blades to be produced in a relatively simple manner. In some examples, the rotor has a rotor blade support supporting the rotor blades and a rotationally symmetrical guide contour, against which working medium may flow to deflect a flow path for working medium between the rotor ducts and a diffuser. In examples where the guide contour of the blade support extends into the diffuser, turbulence in the working medium emerging from the rotor blade ducts may be avoided. In some example turbomachines, rotor blades can be fixed releasably on the rotor blade support or can be connected materially (e.g., integral or adhered) to the rotor blade support. In some examples, it is advantageous when the guide blade ducts in the housing of the turbomachine are formed by spiral guide blades, which are mounted on an annular guide blade support, covered by a cover and have a convex blade surface that faces away from the axis of rotation. In some examples, the guide blade and the guide blade support are connected materially. In some examples, the guide blades have blade surfaces which are parallel to the axis of rotation. In some examples, the distance between two adjacent guide blades can increase in a direction of flow of the working medium toward the rotor ducts. In some examples, the height of the guide blades decreases with increasing distance from the axis of rotation (e.g., at least as far as a constriction at a defined radial distance from the axis of rotation). In some examples, the guide blade support and the cover preferably define a compensating space, which is open toward the housing duct, opens into the guide blade ducts and has a cross section that tapers in a direction toward the axis of rotation.

In some examples, the guide blade support and the guide blades are manufactured from a one-piece flanged socket by erosion, milling and/or electrolytic machining, thereby enabling low-cost production. In some examples, the turbomachine is suitable, in particular, for use in an ORC process or a compressor to compress a gaseous medium containing organic constituents.

As set forth herein, one example turbomachine includes a housing having a housing duct for the inflow or outflow of working medium and a rotor positioned to be rotatable about an axis of rotation and having a multiplicity of rotor blades that define rotor blade ducts, where the rotor blade ducts fluidly communicate with the housing duct via guide blade ducts that are fixed in relation to the housing and have a guide blade duct opening on the rotor side and a guide blade duct opening on the housing duct side.

In some examples, the guide blade ducts have a concave wall surface that faces the rotor and which working medium can flow against. In some examples, the guide blade ducts have a convex wall surface that faces away from the rotor and which working medium can flow against. In some examples, the guide blade ducts have a constriction and a divergent cross section between the constriction and the guide blade duct opening on the rotor side. In some examples, the guide blade ducts have a convergent cross section between the constriction and the guide blade duct opening on the housing duct side. In some examples, the guide blade ducts have a width that increases from the constriction toward the guide blade duct opening on the rotor side in a plane perpendicular to the axis of rotation in a region between the guide blade duct opening on the housing duct side and the guide blade duct opening on the rotor side. In some examples, the guide blade ducts have a height that increases from the constriction toward the guide blade duct opening on the rotor side in relation to a plane perpendicular to the axis of rotation between the guide blade duct opening on the housing duct side and the guide blade duct opening on the rotor side.

In some examples, the guide blade ducts each have a center line spaced apart uniformly from a wall surface facing the rotor and a wall surface facing away from the rotor, the center line dividing the cross-sectional profile of a guide blade duct into a segment on the housing duct side and a segment on the rotor side, where the cross-sectional profile of each guide blade duct is asymmetrical in relation to the center line. In some examples, the segment on the housing duct side and the segment on the rotor side each have a free cross-sectional area for the passage of working medium, and where the free cross-sectional area of the segment on the rotor side is larger than the free cross-sectional area of the segment on the housing duct side. In some examples, the guide blade duct openings on the housing duct side lie on a cylindrical circumferential surface positioned coaxially with the axis of rotation, and the guide blade ducts guide the working medium in the center with a flow path that passes through the cylinder circumferential surface at a point of intersection at which the tangent to the flow path and the tangent to the cylinder circumferential surface form an angle $\alpha 1$ to which the following applies: $5° \leq \alpha 1 \leq 20°$, where the tangent to the cylinder circumferential surface lies in a plane perpendicular to the axis of rotation.

In some examples, the guide blade duct openings are located in an outward circumference of the rotor. In some examples, the guide blade duct openings on the rotor side lie on a cylinder circumferential surface positioned coaxially with the axis of rotation and guide the working medium in the center with a flow path that passes through the cylinder circumferential surface at a point of intersection at which the tangent to the flow path and the tangent to the cylinder circumferential surface form an angle $\alpha 2$ to which the following applies: $5° \leq \alpha 2 \leq 20°$, where the tangent to the cylinder circumferential surface lies in a plane perpendicular to the axis of rotation. In some examples, the rotor blades have a substantially crescent-shaped cross-sectional contour and a concave blade surface that extends from a first blade edge, which faces the guide blade ducts, to a second blade edge, which faces away from the guide blade ducts, where a tangent lying in a plane perpendicular to the axis of rotation and applied to the concave blade surface at the first blade edge forms an obtuse angle: $\widetilde{\beta 1} := \beta 1 + 90°$ with a straight line that passes through the first blade edge and perpendicularly intersects the axis of rotation, where $5° \leq \widetilde{\beta 1} - 90° \leq 45°$.

In some examples, a tangent lying in a plane perpendicular to the axis of rotation and applied to the concave blade surface at the second blade edge forms an acute angle: $\widetilde{\beta 2} := 90° - \beta 2$ with a straight line that passes through the second blade edge and perpendicularly intersects the axis of rotation, where $5° \leq 90° - \widetilde{\beta 2} \leq 90°$. In some examples, the obtuse angle $\widetilde{\beta 1} := \beta 1 + 90°$ and the acute angle $\widetilde{\beta 2} := 90° - \beta 2$ satisfy the following relation: $\widetilde{\beta 1} < 180° - \widetilde{\beta 2}$. In some examples, the blade surface of the rotor blades are substantially parallel to the axis of rotation. In some examples, the distance $r_2$ of the first blade edge of each rotor blade, which faces the guide blade ducts, from the axis of rotation and the distance $r_1$ of the second blade edge of each rotor blade, which faces away from the guide blade ducts, from the axis of rotation satisfy the following relation: $70\%<r_1/r_2<80\%$.

In some examples, the number Z of rotor blades of the rotor satisfies the following relation: $Z\approx C\cdot r_1/r_2$, where the distance $r_2$ of the first blade edge of each rotor blade, which faces the guide blade ducts, from the axis of rotation and the distance $r_1$ of the second blade edge of each rotor blade, the second blade edge facing away from the guide blade ducts, from the axis of rotation, where C is a constant and $70\leq C\leq 90$. In some examples, the distance $r_2$ of the first blade edge of each rotor blade, the first blade edge facing the guide blade ducts, from the axis of rotation and the height of the first blade edge of each rotor blade, the height being parallel to the axis of rotation, satisfy the following relation: $12\%\leq h_E/r_2\leq 28\%$. In some examples, the rotor has a rotor blade support to support the rotor blades and a rotationally symmetrical guide contour, against which working medium can flow and which deflects a flow path for the working medium between the rotor blade ducts and a diffuser space. In some examples, the guide contour extends into the diffuser space. In some examples, where the rotor blades are fixed releasably on the rotor blade support. In some examples, the rotor blades and the rotor blade support are coupled or integrally formed from a solid material by one or more of turning, erosion, milling or electrolytic machining of the solid material. In some examples, the guide blade ducts in the housing are formed spiral guide blades, which are mounted on an annular guide blade support, covered by a cover and have a convex blade surface facing away from the axis of rotation.

In some examples, the guide blade support and the guide blades are coupled or manufactured from a one-piece flanged socket by one or more of erosion, milling or electrolytic machining. In some examples, the guide blades have blade surfaces that are parallel to the axis of rotation. In some examples, the distance between two adjacent guide blades increases in a direction of flow of the working medium toward the rotor blade ducts. In some examples, where the height of the guide blades decreases with increasing distance from the axis of rotation. In some examples, the guide blade support and the cover define a compensating space, which is open toward the housing duct, opens into the guide blade ducts and has a cross section that tapers in a direction toward the axis of rotation. In some examples, the turbomachine is used as a turbine in an Organic Rankine Cycle process or as a compressor for compressing gaseous medium.

Another example turbomachine includes a rotor rotatable about an axis of rotation and having rotor blade ducts, a housing having housing ducts to allow the inflow or outflow of working medium and guide blade ducts fixed in the housing, where the rotor blade ducts are in fluid communication with the housing ducts via the guide blade ducts.

In some examples, the guide blade ducts in the housing are formed by spiral guide blades, which are mounted on an annular guide blade support, covered by a cover and have a convex blade surface facing away from the axis of rotation. In some examples, the guide blade support and the guide blades are coupled or integral with one another. In some examples, the guide blades have blade surfaces that are substantially parallel to the axis of rotation.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A turbomachine compressor for compressing a working medium, the turbomachine compressor comprising:

a housing having a housing duct with a pipe connection for discharging the compressed working medium;

a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duet side, wherein the guide blade ducts have a constriction and a divergent cross section between the constriction and the guide blade duct opening on the rotor side, and wherein the guide blade ducts have a convergent cross section between the constriction and the guide blade duct opening on the housing duct side; and wherein the guide blade ducts have a concave wall surface that faces the rotor, wherein the working medium can flow against the concave wall surface.

2. The turbomachine compressor as defined in claim 1, wherein the guide blade ducts have a convex wall surface that faces away from the rotor, wherein the working medium can flow against the convex wall surface.

3. The turbomachine compressor as defined in claim 1 wherein the guide blade duct openings are located in an outward circumference of the rotor.

4. The turbomachine compressor as defined in claim 1, wherein the guide blade ducts are positioned around outer diameters of the rotor blade ducts.

5. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, wherein the guide blade ducts have a convergent cross section between the constriction and the guide blade duct opening on the housing duct side, and wherein the guide blade ducts have a width that increases from the constriction toward the guide blade duct opening on the rotor side in a plane perpendicular to the axis of rotation in a region between the guide blade duct opening on the housing duct side and the guide blade duct opening on the rotor side.

6. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, wherein the guide blade ducts have a convergent cross section between the constriction and the guide blade duct opening on the housing duct side, and wherein the guide blade ducts have a height that increases from the constriction toward the guide blade duct opening on the rotor side in relation to a plane perpendicular to the axis of rotation between the guide blade duct opening on the housing duct side and the guide blade duct opening on the rotor side.

7. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, and wherein the guide blade ducts have a convergent cross section between the constriction and the guide blade duct opening on the housing duct side, and wherein the guide blade ducts each have a center line spaced apart uniformly from a wall surface facing the rotor and a wall surface facing away from the rotor, the center line dividing the cross-sectional profile of a guide blade duct into a segment on the housing duct side and a segment on the rotor side, wherein the cross-sectional profile of each guide blade duct is asymmetrical in relation to the center line.

8. The turbomachine as defined in claim 7, wherein the segment on the housing duct side and the segment on the rotor side each have a free cross-sectional area for the passage of working medium, and wherein the free cross-sectional area of the segment on the rotor side is larger than the free cross-sectional area of the segment on the housing duct side.

9. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, wherein the guide blade ducts have a convergent cross section between the constriction and the guide blade duct opening on the housing duct side, and wherein the guide blade duct openings on the housing duct side lie on a cylindrical circumferential surface positioned coaxially with the axis of rotation, and the guide blade ducts guide the working medium in the center with a flow path that passes through the cylinder circumferential surface at a point of intersection at which the tangent to the flow path and the tangent to the cylinder circumferential surface form an angle $\alpha 1$ to which the following applies: $5° \leq \alpha 1 \leq 20°$, wherein the tangent to the cylinder circumferential surface lies in a plane perpendicular to the axis of rotation.

10. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, and wherein the guide blade ducts have a convergent cross section between the constriction and the guide blade duct opening on the housing duct side, and wherein the guide blade duct openings on the rotor side lie on a cylinder circumferential surface positioned coaxially with the axis of rotation and guide the working medium in the center with a flow path that passes through the cylinder circumferential surface at a point of intersection at which the tangent to the flow path and the tangent to the cylinder circumferential surface form an angle $\alpha 2$ to which the following applies: $5° \leq \alpha 2 \leq 20°$, wherein the tangent to the cylinder circumferential surface lies in a plane perpendicular to the axis of rotation.

11. The turbomachine as defined in claim 9, wherein the rotor blades have a substantially crescent-shaped cross-sectional contour and a concave blade surface that extends from a first blade edge, which faces the guide blade ducts, to a second blade edge, which faces away from the guide blade ducts, wherein a tangent lying in a plane perpendicular to the axis of rotation and applied to the concave blade surface at the first blade edge forms an obtuse angle $\widetilde{\beta 1} := \beta 1 + 90°$ with a straight line that passes through the first blade edge and perpendicularly intersects the axis of rotation, wherein $5° \leq \widetilde{\beta 1} - 90° \leq 45°$.

12. The turbomachine as defined in claim 11, wherein a tangent lying in a plane perpendicular to the axis of rotation and applied to the concave blade surface at the second blade edge forms an acute angle $\widetilde{\beta 2} := 90° - \beta 2$ with a straight line that passes through the second blade edge and perpendicularly intersects the axis of rotation, and wherein $5° \leq 90° - \widetilde{\beta 2} \leq 90°$.

13. The turbomachine as defined in claim 12, wherein the obtuse angle $\widetilde{\beta 1} = \beta 1 + 90°$ and the acute angle $\widetilde{\beta 2} := 90° - \beta 2$ satisfy the following relation: $\widetilde{\beta 1} < 180° - \beta 2$.

14. The turbomachine as defined in claim 11, wherein the blade surface of the rotor blades are substantially parallel to the axis of rotation.

15. The turbomachine as defined in claim 11, wherein the distance $r_2$ of the first blade edge of each rotor blade, which faces the guide blade ducts, from the axis of rotation and the distance $r_1$ of the second blade edge of each rotor blade, which faces away from the guide blade ducts, from the axis of rotation satisfy the following relation: $70\% < r_1/r_2 < 80\%$.

16. The turbomachine as defined in claim 11, wherein the number Z of rotor blades of the rotor satisfies the following relation:

$Z \approx C \cdot r_1/r_2$, wherein the distance $r_2$ of the first blade edge of each rotor blade, which faces the guide blade ducts, from the axis of rotation and the distance $r_1$ of the second blade edge of each rotor blade, the second blade edge facing away from the guide blade ducts, from the axis of rotation, wherein C is a constant and $70 \leq C \leq 90$.

17. The turbomachine as defined in claim 11, wherein the distance $r_2$ of the first blade edge of each rotor blade, the first blade edge facing the guide blade ducts, from the axis of rotation and the height of the first blade edge of each rotor blade, the height being parallel to the axis of rotation, satisfy the following relation: $12\% \leq h_E/r_2 \leq 28\%$.

18. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, wherein the guide blade ducts have a convergent cross section between the constriction and the guide blade duct opening on the housing duct side, wherein guide blades that define the guide blade ducts are positioned radially outward from an outer periphery of the rotor, and wherein the rotor has a rotor blade support to support the rotor blades and a rotationally symmetrical guide contour, against which working medium can flow and which deflects a flow path for the working medium between the rotor blade ducts and a diffuser space.

19. The turbomachine as defined in claim 18, wherein the guide contour extends into the diffuser space.

20. The turbomachine as defined in claim 18, wherein the rotor blades and the rotor blade support are coupled together, or manufactured from an integral solid material by one or more of turning, erosion, milling or electrolytic machining of the solid material.

21. A turbomachine comprising:

a housing having a housing duct for an inflow or an outflow of working medium, and a rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, wherein the guide blade ducts have a convergent cross section between the constriction and the guide blade duct opening on the housing duct side, wherein guide blades that define the guide blade ducts are positioned radially outward from an outer periphery of the rotor, and wherein the guide blade ducts in the housing are formed by spiral guide blades, which are mounted on an annular guide blade support, covered by a cover and have a convex blade surface facing away from the axis of rotation.

22. The turbomachine as defined in claim 21, wherein the annular guide blade support and the guide blades are coupled together or manufactured from a one-piece flanged socket by one or more of erosion, milling or electrolytic machining.

23. The turbomachine as defined in claim 21, wherein the guide blades have blade surfaces that are parallel to the axis of rotation.

24. The turbomachine as defined in claim 23, wherein a distance between two adjacent guide blades increases in a direction of flow of the working medium toward the rotor blade ducts.

25. The turbomachine as defined in claim 24, wherein the height of the guide blades decreases with increasing distance from the axis of rotation.

26. The turbomachine as defined in claim 21, wherein the annular guide blade support and the cover define a compensating space, which is open toward the housing duct, opens into the guide blade ducts and has a cross section that tapers in a direction toward the axis of rotation.

27. A turbomachine comprising:

a housing having a housing duct for an inflow of steam, and a rotor operatively coupled to a generator, the rotor positioned to be rotatable about an axis of rotation and having a multiplicity of rotor blades that define rotor blade ducts, wherein the rotor blade ducts fluidly communicate with the housing duct via guide blade ducts that are fixed in relation to the housing and have a guide blade duct opening on a rotor side and a guide blade duct opening on a housing duct side, wherein the guide blade ducts have a constriction and a divergent cross section between the constriction and the guide blade duct opening on the rotor side, wherein the guide blade ducts have a convergent cross section between the constriction and the guide blade duct opening on the housing duct side, wherein guide blades that define the guide blade ducts are positioned radially outward from an outer periphery of the rotor and wherein the turbomachine is a steam turbine in an Organic Rankine Cycle process.

* * * * *